US008736535B2

(12) United States Patent
Kimura

(10) Patent No.: US 8,736,535 B2
(45) Date of Patent: May 27, 2014

(54) HOLD TYPE IMAGE DISPLAY SYSTEM

(75) Inventor: Hiroaki Kimura, Kanagawa (JP)

(73) Assignee: NLT Technologies, Ltd., Kanagawa (JP)

( * ) Notice: Subject to any disclaimer, the term of this patent is extended or adjusted under 35 U.S.C. 154(b) by 1368 days.

(21) Appl. No.: 12/048,843

(22) Filed: Mar. 14, 2008

(65) Prior Publication Data

US 2008/0238854 A1 Oct. 2, 2008

(30) Foreign Application Priority Data

Mar. 29, 2007 (JP) ..... 2007-086190
Feb. 20, 2008 (JP) ..... 2008-039351

(51) Int. Cl.
*G09G 3/36* (2006.01)

(52) U.S. Cl.
USPC ..... 345/98; 345/87; 345/89; 345/102

(58) Field of Classification Search
USPC ..... 345/46, 50, 55, 76–77, 87–103, 204, 345/214
See application file for complete search history.

(56) References Cited

U.S. PATENT DOCUMENTS

| | | | | |
|---|---|---|---|---|
| 7,006,069 | B2 * | 2/2006 | Tanaka et al. | 345/98 |
| 7,265,741 | B2 * | 9/2007 | Kumamoto et al. | 345/99 |
| 7,889,154 | B2 * | 2/2011 | Araki et al. | 345/55 |
| 7,893,901 | B2 * | 2/2011 | Kang | 345/87 |
| 7,995,025 | B2 * | 8/2011 | Teranishi | 345/100 |
| 2002/0033789 | A1 * | 3/2002 | Miyata et al. | 345/89 |
| 2003/0122772 | A1 | 7/2003 | Park et al. | |
| 2005/0253794 | A1 | 11/2005 | Lee et al. | |
| 2007/0115241 | A1 * | 5/2007 | Teranishi | 345/98 |
| 2007/0182700 | A1 * | 8/2007 | Baba et al. | 345/102 |
| 2007/0211009 | A1 * | 9/2007 | Teranishi | 345/98 |

FOREIGN PATENT DOCUMENTS

| | | | |
|---|---|---|---|
| CN | 1430200 | A | 7/2003 |
| CN | 1505809 | A | 6/2004 |
| CN | 1801304 | A | 7/2006 |
| CN | 1908742 | A | 2/2007 |
| JP | 9-18814 | A | 1/1997 |
| JP | 2001-060078 | A | 3/2001 |
| JP | 2001-166280 | A | 6/2001 |
| JP | 2001184034 | A | 7/2001 |
| JP | 2002-132224 | A | 5/2002 |
| JP | 2002-149132 | A | 5/2002 |

(Continued)

OTHER PUBLICATIONS

Japanese Office Action issued Aug. 20, 2012 in corresponding Japanese Patent Application No. 2008-039351.

(Continued)

*Primary Examiner* — William Boddie
*Assistant Examiner* — Mansour M Said
(74) *Attorney, Agent, or Firm* — Sughrue Mion, PLLC

(57) ABSTRACT

The present invention aims to insert a black screen in one frame period to alleviate moving image blur due to overlap recognition of a current frame image and an afterimage of the previous frame and improve the image quality of the moving image, and to set a black insertion rate with respect to one frame period to a value suited for each usage state. An enable signal (VOE) to each gate driver is independently controlled, and a start pulse (VSP) input to write a black signal is performed at an arbitrary timing within one frame period with respect to the gate driver to insert a black image within one frame period.

12 Claims, 16 Drawing Sheets

(56) References Cited

FOREIGN PATENT DOCUMENTS

| | | | |
|---|---|---|---|
| JP | 2003-233352 | A | 8/2003 |
| JP | 2003-255915 | A | 9/2003 |
| JP | 2003-295156 | A | 10/2003 |
| JP | 2004-029539 | A | 1/2004 |
| JP | 2004-126293 | A | 4/2004 |
| JP | 2004264481 | A | 9/2004 |
| JP | 2005-321701 | A | 11/2005 |
| JP | 2005-345973 | A | 12/2005 |
| JP | 2006-18138 | A | 1/2006 |
| JP | 2006-74419 | A | 3/2006 |
| JP | 2006-106689 | A | 4/2006 |
| JP | 2006189658 | A | 7/2006 |
| JP | 2006-343766 | A | 12/2006 |
| JP | 2006343706 | A | 12/2006 |
| JP | 2008-052259 | A | 3/2008 |
| JP | 2008-102219 | A | 5/2008 |

OTHER PUBLICATIONS

Communication dated Apr. 9, 2013 from the Japanese Patent Office in counterpart application No. 2008-039351.

* cited by examiner

CONTROLLER
7
BLACK INSERTION RATE SETTING UNIT
10
BLACK INSERTION SIGNAL CONVERTING UNIT
8
DRIVE CONTROL UNIT
9
INPUT SIGNAL
HSP
data
HCK
DLP
POL
SOURCE DRIVER
4
1
6
H1
H2
H3
Hn
V1
V2
Vi
V(i+1)
V(i+2)
Vj
Vm
GATE DRIVER
5A
5B
5N
VSP
VCK
VOE(1)
VOE(2)
VOE(n)
H1~Hn
V1~Vm
12
13
14
15
10a

HOLD TYPE IMAGE DISPLAY SYSTEM

CROSS-REFERENCE TO RELATED APPLICATIONS

This application is based upon and claims the benefit of priority from Japanese patent application No. 2007-086190, filed on Mar. 29, 2007, and Japanese patent application No. 2008-039351, filed on Feb. 20, 2008, the disclosure of which is incorporated herein in its entirety by reference.

BACKGROUND OF THE INVENTION

1. Field of the Invention

The present invention relates to a hold type image display system.

2. Description of the Related Art

Conventionally, a liquid crystal display (LCD) is generally being widely used since it is thin and does not occupy as much installation area compared to a CRT (Cathode Ray Tube) display. However, in the hold type display device such as LCD, an image continues through a frame period as opposed to an impulse type display device such as CRT display, and thus a moving image tends to become unclear.

In the case of the impulse type display device, an image is displayed as a pulse at an early stage in the frame, and a black display is displayed until the next frame, and thus the after-image occurrence is adjusted not to be recognized by the user's eyes. In the case of the hold type display device, on the other hand, the image is held and displayed as a still image within the frame period, and the moving image is displayed by switching the screen for every frame, and thus the still image is seamlessly switched from one frame to another, whereby the user recognizes the frame image of one before as an afterimage, senses a double image in which the shifted images are overlapped and recognizes a moving image blur. In order to improve the moving image blur in the hold type display device, a hold type display device for pseudo-driving in an impulse type display is disclosed in Japanese Laid-Open Patent Publication No. 9-18814 (patent document 1).

However, the liquid crystal display device of patent document 1 switches between a black display and a video display for every ½ frame period of an input signal, and thus the black insertion rate with respect to one frame is limited to ½. Thus, in the device of patent document 1, setting an optimum black insertion rate corresponding to each usage state with considering the balance between improvement in moving image blur, which is a merit of black insertion, and lowering in luminance, which is a demerit of black insertion, cannot be realized.

There is a number of liquid crystal driving methods in accordance with the liquid crystal panel, and if the liquid crystal driving method differs in accordance with each type of panels such as TN type, IPS type, VA type, and OCB type, the response property differs and the optimum black insertion rate also differs. With the device of patent document 1, the application of the black insertion drive suited for all the methods was difficult. Furthermore, in the liquid crystal display device of patent document 1, the circuit scale increases and also the cost increases since the drive frequency of the device is required to be doubled and a frame memory for temporarily storing video information becomes necessary.

On the other hand, a device which increases the degree of flexibility of black insertion rate and avoids increase in circuit scale is disclosed in Japanese Laid-Open Patent Publication No. 2001-166280 (patent document 2). As shown in FIGS. 14 to 16, the liquid crystal display device of patent document 2 has a configuration of individually inputting a start pulse signal (VSP) to each gate driver, inputting an enable signal (VOE), or a control signal, to half of the plurality of gate drivers, and inputting an enable signal whose polarity is inverted by an inverter to the remaining half of the gate drivers. One gate line is selected from each half of the gate drivers, respectively, where an video signal corresponding to the enable signal is written to the pixel on one gate line, and a black signal corresponding to the enable signal which polarity is inverted is written to the pixel on the other gate line, so that the black insertion rate of gate driver segmentation can be changed.

However, when commercializing a product having a resolution used for TV, if the gate driver offered in the market is used, two gate drivers are generally used in the VA (Video Graphics Array), and three gate drivers are used in the XGA (Extended Graphics Array) and WXGA (Wide XGA), whereas, in the configuration of the device of patent document 1, the gate driver is limited to an even number, and thus the degrees of flexibility in selecting the number of gate drivers lower when it is applied to a product, and in some cases, an extra gate driver IC becomes necessary thereby a wasteful cost is required.

In the device of patent document 2, one gate driver starts the scanning of the video display, and at the same time, another gate driver specified in advance starts the scanning of the black display, and thus the black insertion rate can only be set at the segment of the gate driver and operation is performed with the fixed black insertion rate with respect to one frame, whereby it is difficult to set an optimum black insertion rate variably according to each usage state.

Furthermore, in the device disclosed in patent document 1, the continuous holding in a blanking period is not taken into consideration in the case of writing the black image over a plurality of frames. Thus, as shown in FIG. 15, a time interval corresponding to the blanking period is created when the writing of the black signal runs to the next frame, thereby creating a difference in the black image holding time between the upper half and the lower half of the screen, and a luminance difference as shown in FIG. 16 is displayed in the one screen, with the line from where the difference in the black image holding time is created as a boundary.

SUMMARY OF THE INVENTION

It is an exemplary object of the invention to provide a hold type image display capable of inserting a black image in one frame period to reduce the moving image blur due to overlapping recognition of the current frame image and the after-image of the frame one before and enhance the image quality of the moving image, and capable of setting the black insertion rate with respect to one frame period variably according to each usage state.

To achieve the exemplary object, a hold type image display system according to an exemplary aspect of the invention relates to a hold type image display system for displaying a video on a display panel by controlling a video signal to be input to a source line and a gate line of the display panel, the hold type image display system including a source driver for outputting a video signal to the source line; a gate driver for outputting a scanning signal to the gate line; and a controller for receiving an input video signal and thereby controlling the source driver and the gate driver; wherein the controller outputs a video signal in which a black or gray line is inserted between video lines to the source driver, outputs a start pulse signal for writing the video lines for one or more times and a start pulse signal for writing black or gray lines for one or more times to the gate driver within one frame period, and scrolls a black band in a screen of the display panel during one frame.

A control device of the hold type image display system according to another exemplary aspect of the invention relates to a control device of a hold type image display system for drive-displaying a video on a display panel by controlling a video signal to a source line of the display panel in a source driver and controlling a signal to a gate line of the display panel in a gate driver; the control device including a controller for receiving an input video signal and thereby controlling the source driver and the gate driver; wherein the controller outputs a video signal in which a black or gray line is inserted between video lines to the source driver, outputs a start pulse signal for writing the video lines for one or more times and a start pulse signal for writing black or gray lines for one or more times to the gate driver within one frame period, and scrolls a black band in a screen of the display panel during one frame.

A hold type image display method according to still another exemplary aspect of the invention relates to a hold type image display method for displaying a video on a display panel by controlling a video signal to be input to a source line and a gate line of the display panel, the hold type image display method including the steps of displaying a video signal by receiving an input video signal and controlling a source driver for outputting a video signal to the source line and a gate driver for outputting a scanning signal to the gate line; and performing black or gray display between the video displays of the display panel by outputting a video signal in which a black or gray line is inserted between video lines to the source driver, outputting a start pulse signal for writing the video lines for one or more times to the gate driver within one frame period, outputting a start pulse signal for writing black or gray lines for one or more times to the gate driver within one frame period, and scrolling a black band in a screen of the display panel during one frame.

A control program of the hold type image display system according to still another exemplary aspect of the invention relates to a control program of a hold type image display system for drive-displaying a video on a display panel by controlling a video signal to a source line of the display panel in a source driver and controlling a signal to a gate line of the display panel in a gate driver, the program causing a computer to output a video signal in which a black or gray line is inserted between video lines to the source driver, and output a start pulse signal for writing the video lines for one or more times and a start pulse signal for writing black or gray lines for one or more times to the gate driver within one frame period.

As an exemplary advantage according to the invention, the present invention can finely adjust the black insertion rate with respect to one frame period while taking into consideration the balance between the merit of improving the moving image blur and the demerit of lowering in luminance in the hold type display device, thereby enhancing the image quality of the moving image.

DETAILED DESCRIPTION OF THE EXEMPLARY EMBODIMENTS

The exemplary embodiments of the present invention will be described in detail below based on the drawings.

As shown in FIGS. 1A-1C and FIG. 8, a hold type image display system according to an exemplary embodiment of the present invention addresses a hold type image display system for displaying a video on a display panel by controlling signals to be input to source lines H1, H2, . . . , Hn and gate lines V1, V2, . . . , Vn of the display panel, and includes a source driver 4 for outputting a video signal to the source lines H1, H2, . . . , Hn, gate drivers 5A, 5B, . . . , 5N for outputting a scanning signal to the gate lines V1, V2, . . . , Vn, and a controller 7 as a basic configuration. The controller 7 outputs a video signal (hereinafter referred to as black insertion video signal) in which a black line or a gray line (hereinafter referred to as just "black" collectively) is inserted between the video lines to the source driver 4 (FIGS. 2 and 7), and outputs a start pulse signal for writing the video lines for one or more times and a start pulse signal for writing a black line for one or more times to the gate drivers 5A, 5B, . . . , 5N within one frame period (FIG. 3).

Figure 3A:
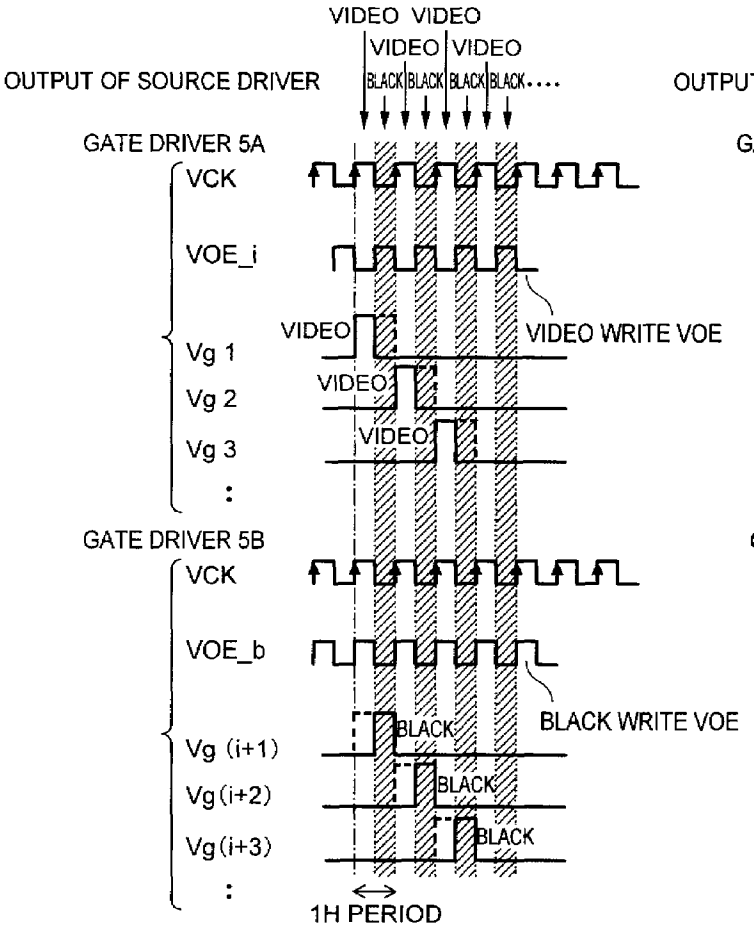
FIG. 3 is a timing chart of a signal propagating through the image display device of the exemplary embodiment shown in FIGS. 1A-1C.
Figure 3B:
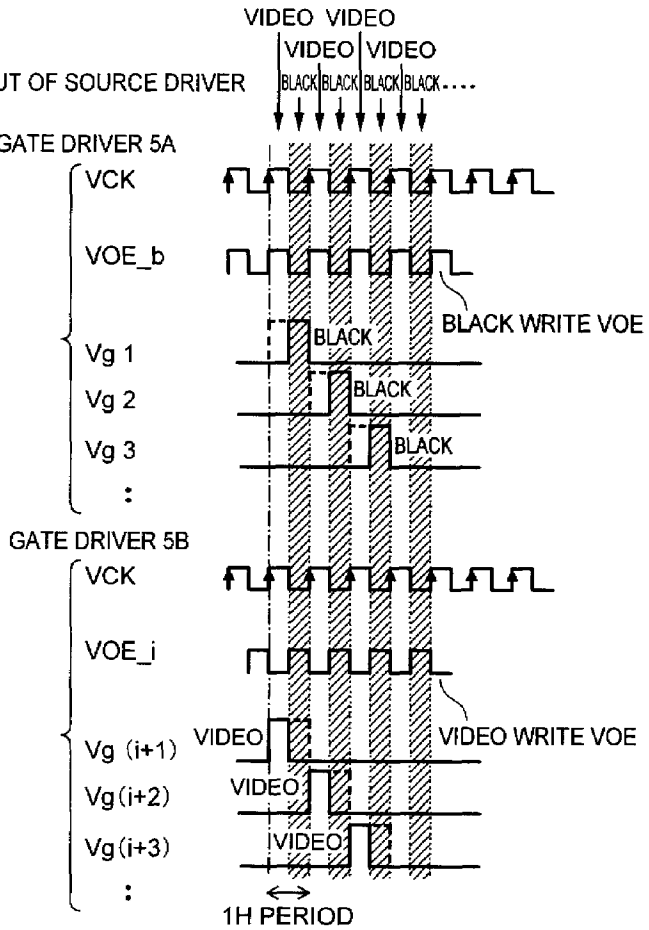
Figure 4:
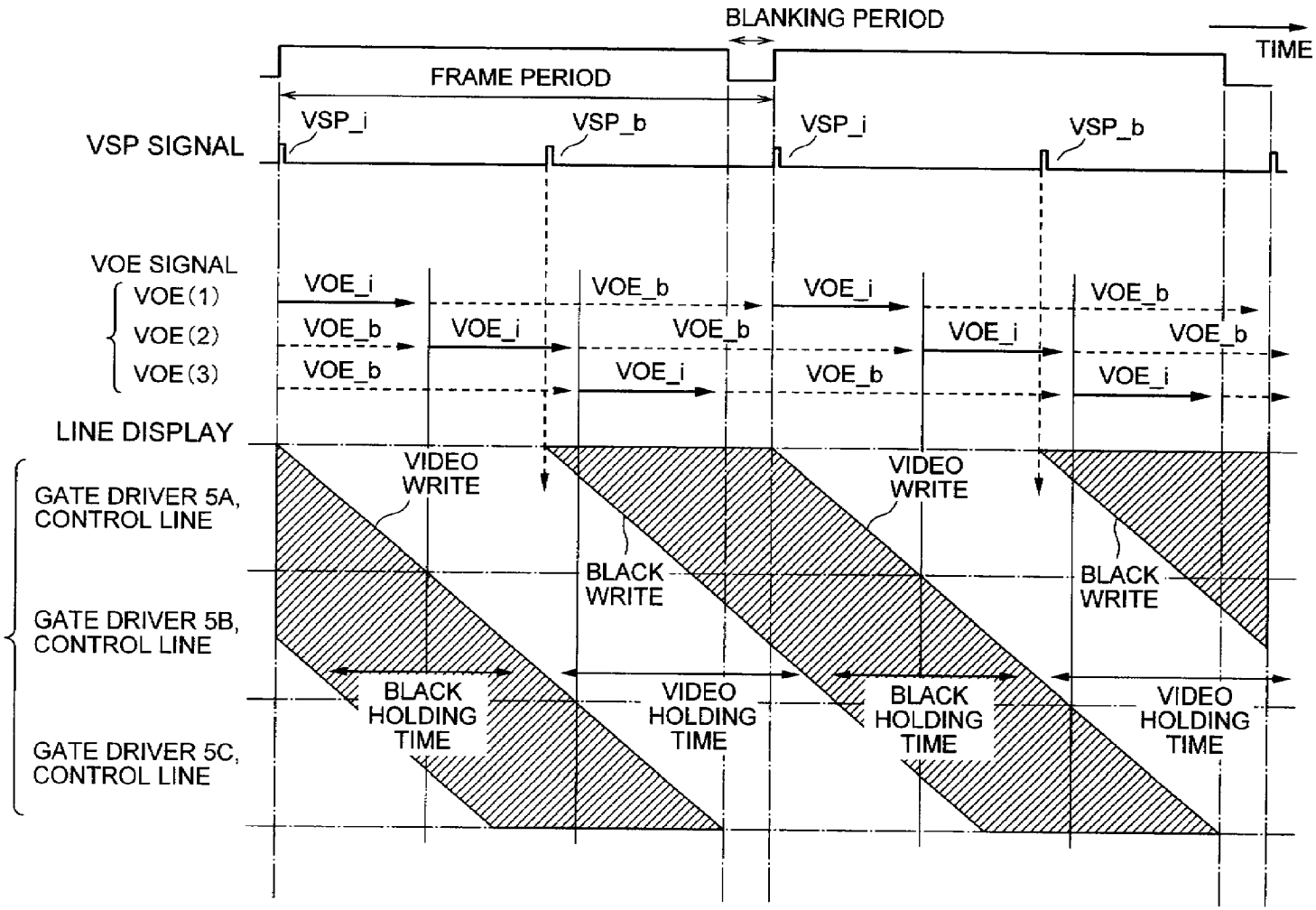
FIG. 4 is an explanatory view showing the operation of the image display device of the exemplary embodiment shown in FIGS. 1A-1C.
Figure 6:
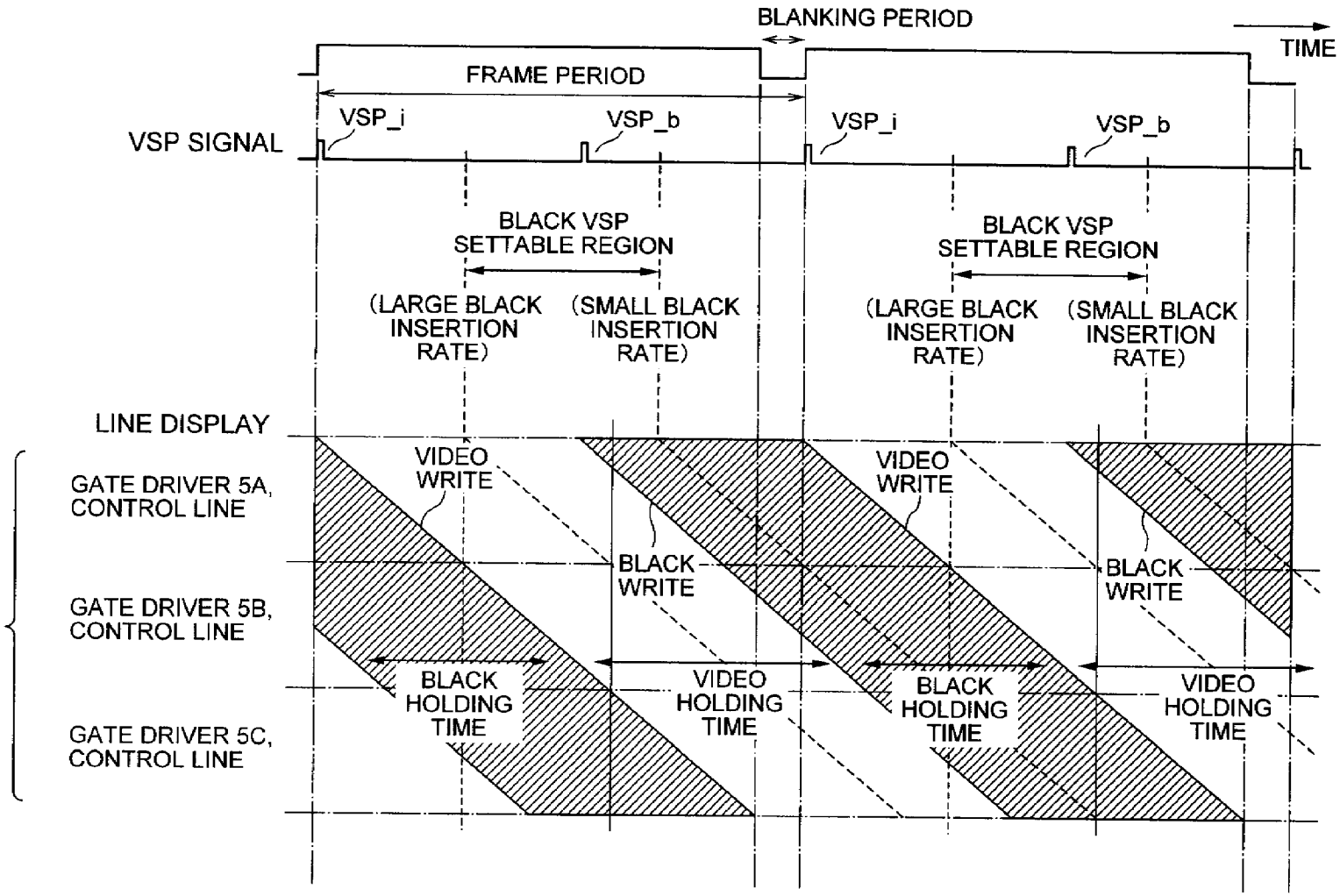
FIG. 6 is an explanatory view showing the operation of the image display device of the exemplary embodiment shown in FIGS. 1A-1C.
Figure 15:
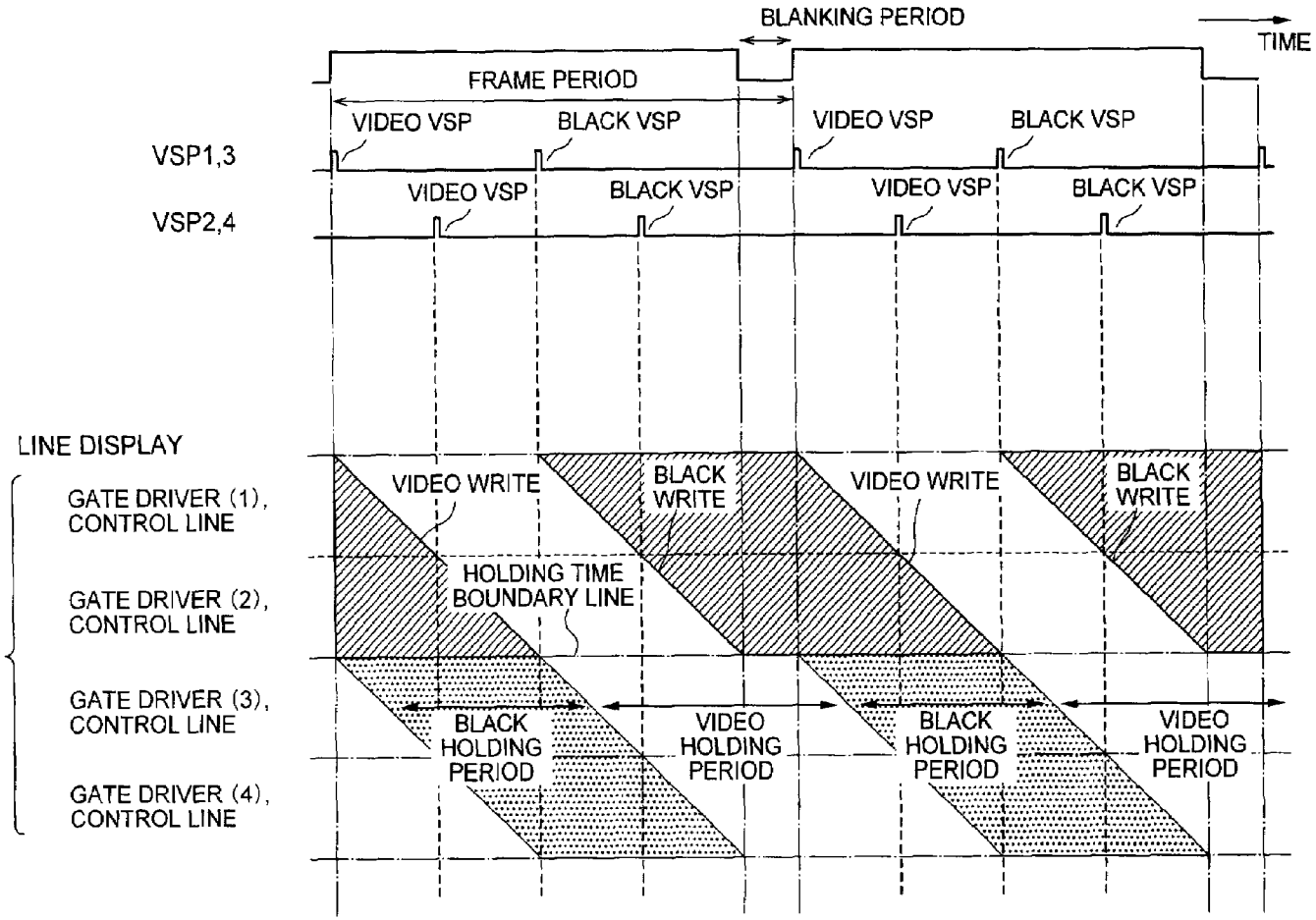
FIG. 15 RELATED ART
FIG. 15 is an explanatory view showing an operation of the conventional image display device.
Figure 16:
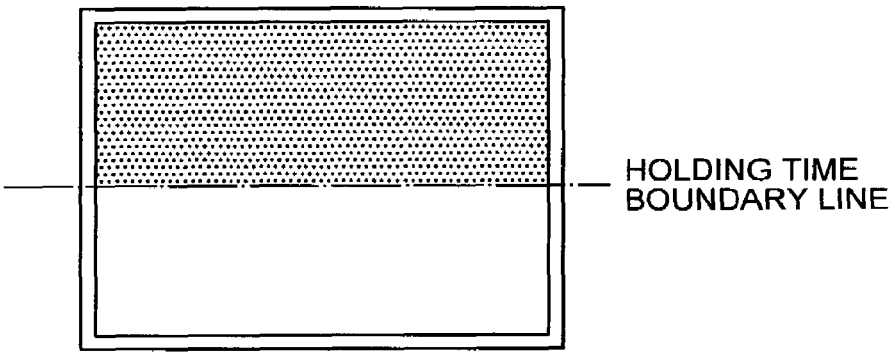
FIG. 16 RELATED ART
FIG. 16 is an explanatory view showing a display screen in the conventional image display device.

The controller 7 changes the timing of input of the start pulse signal (VOE) for writing the black line with respect to the input of the start pulse signal (VSP) to the gate driver 5A for writing the video lines based on the black insertion ration specified by the user or determined based on the input signal (FIGS. 4, 6, 15). The controller 7 outputs the black insertion video signal in which a black line or a gray line is inserted between the video lines to the source driver 4 (FIGS. 2 and 7), and outputs a start pulse signal for writing the video lines for one or more times and a start pulse signal for writing a black line for one or more times to the gate drivers 5A, 5B, . . . , 5N within one frame period (FIG. 3).

In the exemplary embodiment of the present invention, the video signal is displayed by controlling the source driver for outputting the video signal to the source lines and the gate drivers for outputting the scanning signal to the gate lines, and black display is performed between the video displays of the display panel by outputting the video signal in which a black line is inserted between the video lines to the source driver and outputting the start pulse signal for writing the video lines for one or more times and the start pulse signal for writing a black line for one or more times to the gate drivers within one frame period.

Figures 5A, 5B:
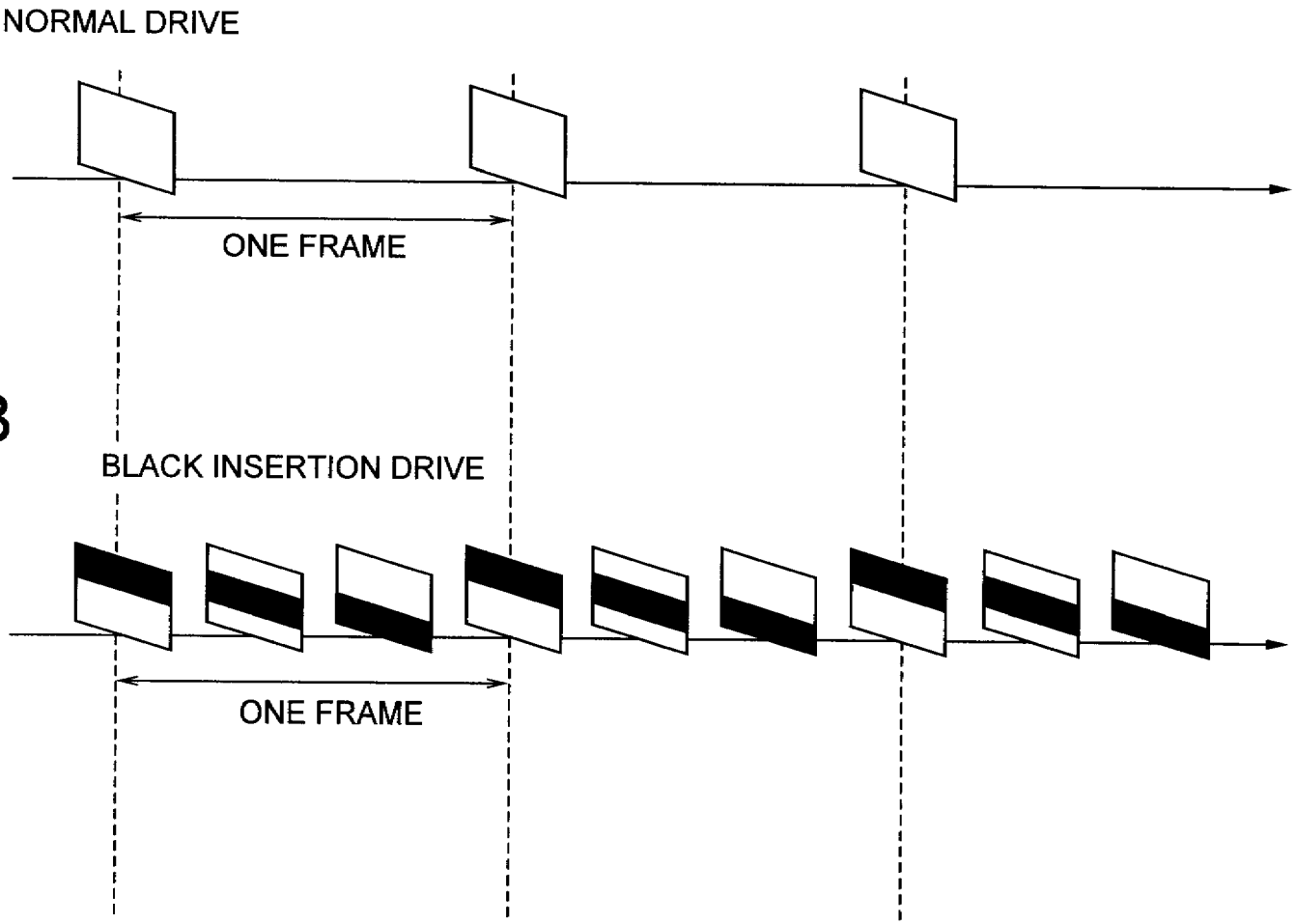
FIG. 5 is an explanatory view showing a moving image display in the image display device of the exemplary embodiment shown in FIGS. 1A-1C.

Specifically describing, as shown in FIG. 5A, the start pulse signal for writing the video lines is input at the start of the frame, and the TFT of the liquid crystal panel is sequentially turned ON while shifting the line (video line) of the screen and while shifting (scanning) the line of the TFT screen of the display panel (liquid crystal panel). An enable signal (VOE_i) for writing the video lines is input to the gate driver 5 during the period of shifting the video line. The controller 7 inputs the start pulse (VSP_b) for writing the black line to the gate driver 5 at an arbitrary position of one frame period according to the determined black insertion rate, and sequentially turns ON the TFT of the display panel (liquid crystal panel) while shifting the video line.

In the above description, the exemplary embodiment of the present invention is built as a hold type image display system serving as hardware, but the functions executed by the controller 7 may be built as a program to be processed in a personal computer. In this case, the control program of the hold type image display system according to the exemplary embodiment of the present invention is built with a configuration for causing a computer to execute a function of outputting the video signal in which a black line is inserted between the video lines to the source driver and, outputting the start pulse signal for writing the video lines for one or more times and the start pulse signal for writing a black line for one or more times to the gate drivers within one frame period.

As shown in FIG. 5B, according to the exemplary embodiment of the present invention, a black band is scrolled in the screen within one frame period, the holding time of the video signal and the holding time of the black signal become constant in all the video lines of the screen, and an in-plane luminance difference caused by difference in holding time is eliminated.

The hold type image display system according to the exemplary embodiment of the present invention will be further described using specific examples applied to the hold type image display system that uses a liquid crystal panel for the display panel.

First Exemplary Embodiment

Figures 1A, 1B, 1C:
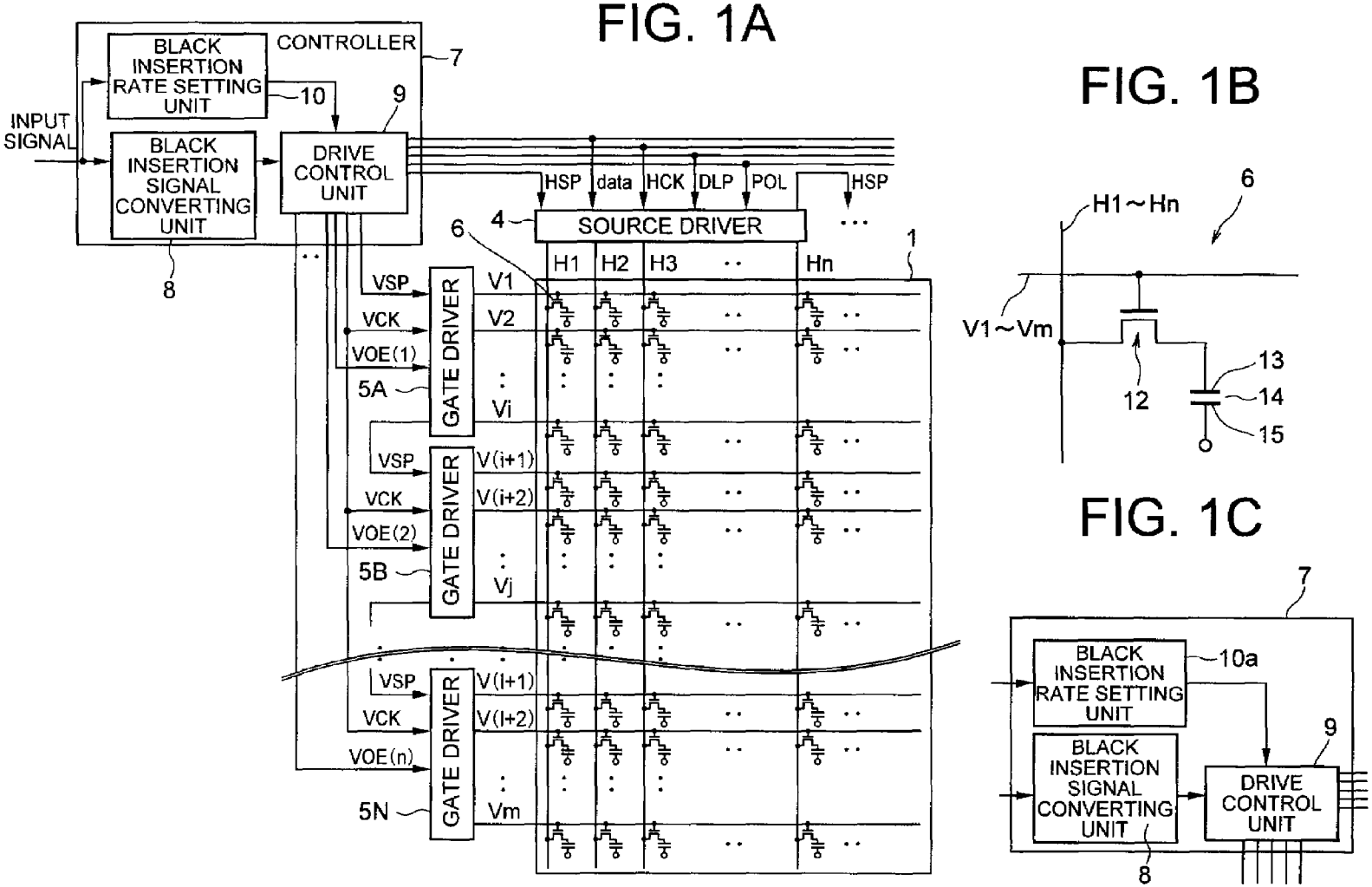
FIG. 1A is a view showing a configuration of an image display device of a first exemplary embodiment according to the present invention.
FIG. 1B is a cross sectional view showing a configuration of a pixel.
FIG. 1C is a view showing another configuration example of a controller.

FIG. 1A is a view showing a configuration of an image display device of a first exemplary embodiment according to the present invention. As shown in FIG. 1A, the image display device of the first exemplary embodiment includes a display panel 1 in which m (m is a natural number) gate lines V1 to Vm and n (n is a natural number) source lines H1 to Hn are arranged so as to intersect each other to a grid form, a pixel 6 being formed at each intersection of the gate lines V1 to Vm and the source lines H1 to Hn; a source driver 4, connected to each source line H1 to Hn, for providing a video signal; and a plurality of gate drivers 5A to 5*n*, arranged with respect to each gate line group, where the plurality of gate lines V1 to Vm are divided into a number of groups, for sequentially providing a gate-ON signal (Vg) to the corresponding gate lines V1 to Vm.

As shown in FIG. 1A, i number of gate lines V1 to Vi from the top are connected to the gate driver 5A, $i+1^{th}$ to $j^{th}$ gate lines V(i+1) to Vj are connected to the gate driver 5B, and the last $l+1^{th}$ to $m^{th}$ gate lines V(l+1) to Vm are connected to the gate driver 5N (not illustrated for $j+1^{th}$ to $j^{th}$ gate lines).

FIG. 1B is a view showing a circuit of one pixel 6 shown in FIG. 1A in an enlarged manner. The circuit of the pixel 6 forming the display panel 1 in the first exemplary embodiment has a configuration in which a source electrode of a thin-film transistor (TFT) 12 is connected to the source lines H1 to Hn, a gate electrode of the TFT 12 is connected to the gate lines V1 to Vm, a drain electrode of the TFT 12 is connected to a pixel electrode 13 formed on one glass substrate, and a liquid crystal layer 14 is sandwiched between the pixel electrode 13 formed in one glass substrate and a common electrode 15 formed in another glass substrate.

The video display is carried out with the optical transmittance of the liquid crystal layer 14 controlled by the potential difference between the pixel electrode 13 and the common electrode 15, but when the video signal is written to the pixel 6, the gate-ON signal (Vg1 to Vgm) transmitted via the gate lines V1 to Vm turns ON the TFT 12 thereby applying the tone voltage corresponding to the video signal from the source lines H1 to Hn to the pixel electrode 13, and a video display based on the video signal is realized while controlling the optical transmittance of the liquid crystal layer 14 by the potential difference between the common electrode 15 set at a constant voltage and the pixel electrode 13 applied with the tone voltage.

The image display device of the first exemplary embodiment includes the controller 7 for controlling the operation of the source driver 4 and the gate drivers 5A to 5N, which controller 7 includes a black insertion signal converting unit 8 for inserting a black image signal to an input video signal, creating a black insertion video signal containing a video signal portion and a black image signal portion within a horizontal scanning period and outputting the same, and a drive control unit 9 for outputting the black insertion video signal from the black insertion signal converting unit 8 to the source driver 4.

Figure 2:
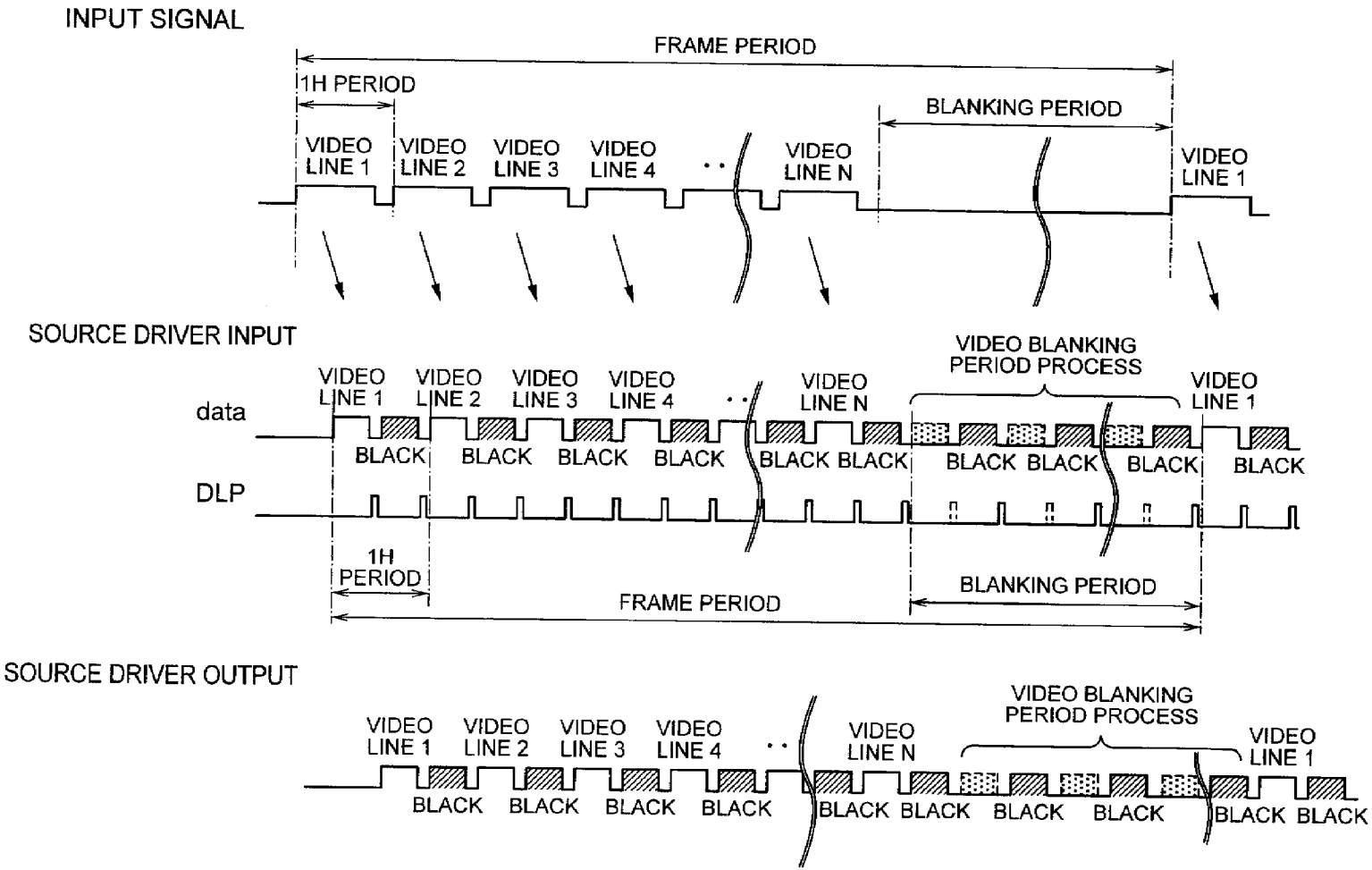
FIG. 2 is an explanatory view showing a step of creating a black insertion video signal in the exemplary embodiment shown in FIGS. 1A-1C.

As shown in FIG. 2, one frame period is divided into write periods (horizontal scanning periods) of the same number as the number (m) of gate lines V1 to Vm, and, assuming the portion corresponding to the write period of the input video signal as a line image portion (horizontal scanning period portion), the black insertion signal converting unit 8 has a function of inserting the black image signal between the line image portions in the input video signal and similarly inserting the black image signal to a blanking period in the input video signal. In FIG. 2, a case of inserting the black image signal to the input video signal having a dummy signal output in the blanking period is shown, but the invention is not limited thereto, and the black insertion signal converting unit 8 similarly inserts the black image signal in a case of input video signal without dummy signal output in the blanking period. Generally, the video signal takes various forms, for example, the dummy signal output is present or no output is present in the blanking period.

The source driver 4 serves as a source line driving device by alternately outputting the line image portion and the black image portion to the source lines H1 to Hn according to the black insertion video signal.

Figure 7:
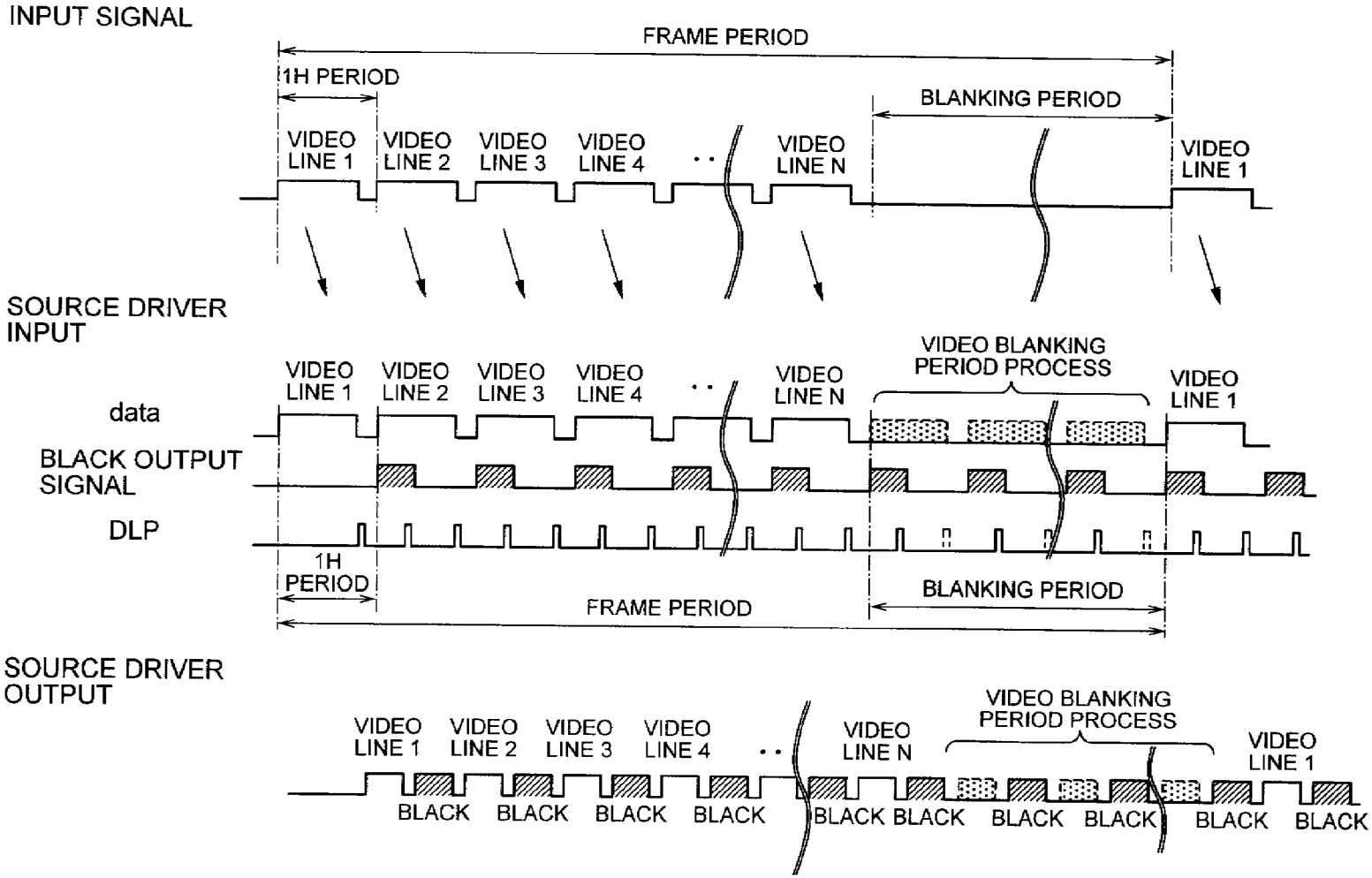
FIG. 7 is an explanatory view showing another example of the step of generating a black insertion video signal in the exemplary embodiment shown in FIGS. 1A-1C.

In the first exemplary embodiment, a configuration of inputting the black insertion video signal created by the black insertion signal converting unit 8 to the source driver 4 and outputting the same to the source lines H1 to Hn at double speed drive has been described, but is not limited thereto, and the source driver 4 may have a function of having the output charge to the source lines H1 to Hn as tone charge corresponding to the black display, so that the input video signal is output to the source lines H1 to Hn while switching the output charge to the tone charge corresponding to the black display at a constant interval, as shown in FIG. 7. The black insertion signal converting unit 8 then does not need to be arranged, that is, the line memory necessary for black image insertion can be reduced, and the drive frequency of the source driver 4 involved in black image insertion does not need to be doubled.

The drive control unit 9 has a function of individually providing an output enable signal for controlling opening/closing of the gate output at the gate drivers 5A to 5N to the gate drivers 5A to 5N, and specifically, has a function of individually providing, to the gate drivers 5A to 5N, a video display enable signal (VOE_i) for validating the output of the gate-ON signal only during the period the line image portion of the black insertion video signal is being provided to the source lines H1 to Hn, or a black display enable signal (VOE_b) for validating the output of the gate-ON signal only during the period the black image portion of the black insertion video signal is being provided to the source lines H1 to Hn.

Accordingly, each gate driver 5A to 5N has a function of collectively controlling the output on the connected gate lines V1 to Vi, V(i+1) to Vj, . . . , V(l+1) to Vm, and specifically, has a function serving as a video scanning device for having the gate-ON signal as the video display gate-ON signal of a pulse width for writing only the line image portion of the black insertion video signal to the pixel 6 in response to the VOE_i from the drive control unit 9, sequentially providing the same to the gate lines V1 to Vi, V(i+1) to Vj, . . . , V(l+1) to Vm and sequentially executing the video display scanning, and a function serving as a black scanning device for having the gate-ON signal as the black display gate-ON signal of a pulse width for writing only the black image portion of the black insertion video signal to the pixel 6 in response to the VOE_b, sequentially providing the same to the gate lines V1 to Vi, V(i+1) to Vj, . . . , V(l+1) to Vm and sequentially executing the black image display scanning.

The drive control unit 9 has a function of outputting a video display scanning start pulse (VSP_i) for writing the video lines and a black display scanning start pulse (VSP_b) for writing the black image line to the gate driver 5A, for once in a frame period, respectively, at different timings. The drive control unit 9 outputs the VSP_i to the gate driver 5A at the start of video display scanning, and at the same time, starts to provide the VOE_i to the gate driver 5A. When the video display scanning is terminated at the gate driver 5A, the provision of the VOE_b to the gate driver 5A is started, and the VSP_b is output to the gate driver 5A at an arbitrary timing within one video frame period specified by the VSP_i.

Further, the controller 7 includes a black insertion rate setting unit 10 for arbitrarily setting the timing of the black display start pulse (VSP_b) output by the drive control unit 9 according to the operation environment. The controller 7 includes the black insertion rate setting unit 10, but is not limited thereto. As shown in FIG. 1C, a black insertion rate setting unit 10*a* may be arranged in place of the black insertion rate setting unit 10. The black insertion rate setting unit 10*a* is input with data of black insertion rate by the user irrespective of the input signal, outputs the black insertion rate to the drive control unit 9. When the black insertion rate setting unit 10*a* is used, the user inputs the data of black insertion rate corresponding to the in-plane luminance difference to the black insertion rate setting unit 10*a* while looking at the screen. Therefore, the black insertion rate that complies with the user can be set.

The black insertion rate setting unit 10 has a function of determining the black image insertion rate for every frame period while referencing the input video signal, and also has a function of setting the timing of the VSP_b output by the drive control unit 9 in correspondence to the determined black image insertion rate. Specifically, the black insertion rate setting unit 10 includes a frame memory (not shown) for temporarily storing information for one frame of the input video signal sequentially input for every frame, and a determining unit (not shown) for comparing the video signal of one frame of the input video signal and the video signal of the frame one before stored in the frame memory, and determining the optimum black image insertion rate based on the changed data.

Thus, the black image insertion rate for every frame period suited to the driving method, the usage state, and the like of the display panel 1 is determined, and the timing of the VSP_b output for realizing the determined black image insertion rate is set. The timing set here is the timing at which the pixel lines for writing the video lines and for writing the black image line are not simultaneously selected with one gate driver.

Accordingly, the gate driver 5A is input with the VSP_b from the drive control unit 9 at a timing set by the black insertion rate setting unit 10, sequentially provides the VSP_b to the gate lines V1 to Vi as the black display gate-ON signal based on the VOE_b provided in advance, and shift outputs the VSP_b to the gate driver 5B when scanning is terminated. The black image insertion rate for every one frame determined in the black insertion rate setting unit 10 is realized when the gate drivers 5A to 5N sequentially perform such scanning.

The drive control unit 9 provides the black insertion video signal (data), and also provides a signal start pulse (HSP), a horizontal clock signal (HCK), a latch signal (DLP), and a polarity inverting control signal (POL), which are signals for drive controlling the source driver 4, to the source driver 4, and provides a scanning start pulse (VSP_i or VSP_b), a vertical clock signal (VCK), and an enable signal (VOE_i or VOE_b), which are signals for drive controlling the gate drivers 5A to 5N, to the gate drivers 5A to 5N.

The source driver 4 has a function similar to that which is generally used. For instance, the source driver starts retrieving data signal by input of HSP, and sequentially accumulates the data signal in a shift register arranged inside in synchronization with HCK. The source driver confirms the data signal by the input of DLP, and at the same time, confirms whether it is positive or negative from the reference voltage according to POL, and outputs the tone voltage corresponding to the data signal to the source lines H1 to Hn.

The polarity inverting control signal (POL) is a control signal for inverting the voltage polarity of the tone voltage output from the source driver 4 to the source lines H1 to Hn.

The direct current voltage is prevented from being applied to the liquid crystal by controlling the POL.

The black insertion signal converting unit 8, the drive control unit 9, and the black insertion rate setting unit 10 in the controller 7 may have the functional contents thereof programmed to be executed by a computer.

FIG. 3 is a timing chart of a signal propagating through the image display device of the first exemplary embodiment.

FIG. 3A is a timing chart for a case where the line image signal is provided to the pixel 6 on the gate lines V1 to Vi corresponding to the gate driver 5A, and the black image signal is provided to the pixel 6 on the gate lines V(i+1) to Vj corresponding to the gate driver 5B; and FIG. 3B is a timing chart for a case where the black image signal is provided to the pixel 6 on the gate lines V1 to Vi corresponding to the gate driver 5A, and the line image signal is provided to the pixel 6 on the gate lines V(i+1) to Vj corresponding to the gate driver 5B.

As shown in FIG. 3A, the VOE_i is input to the gate driver 5A when providing the line image signal to the pixel 6 on the corresponding gate lines V1 to Vi, whereby the gate-ON signal is converted to the video display gate-ON signal having the same pulse width as the line image signal output period of the source driver 4, and is sequentially provided to the gate lines V1 to Vi from the gate driver 5A.

The VOE_b is input to the gate driver 5B when providing the black image signal to the pixel 6 on the gate lines V(i+1) to Vj, whereby the gate-ON signal is converted to the black display gate-ON signal having the same pulse width as the black image signal output period of the source driver 4, and is sequentially provided to the gate lines V(i+1) to Vj from the gate driver 5B.

Thus, in the first embodiment, the video signal or the black image signal can be written to different pixel lines in 1H period (one horizontal scanning period).

The operation of the image display device of the first exemplary embodiment will now be described. FIG. 4 is a view describing the operation of the image display device of the present exemplary embodiment. Each step in the method of driving the image display device of the present invention will also be shown to be simultaneously described.

The black image insertion rate for every frame period is determined and set based on the video signal input by the black insertion rate setting unit 10 (black insertion rate setting step). On the other hand, in the black insertion signal converting unit 8, the black image signal is inserted between the line image portions of the input video signal, and output to the drive control unit 9 as a black insertion video signal (black insertion signal converting step).

When the black insertion video signal is output from the drive control unit 9 to each source driver 4, various drive control signals are output to the gate drivers 5A to 5N and each source driver 4 in synchronization therewith.

In the first exemplary embodiment, a plurality of gate drivers capable of collectively enabling the gate output is used, and the gate drivers 5A to 5N are controlled by an independent output enable signal (VOE_i or VOE_b) from the drive control unit 9.

As shown in FIG. 2, the black insertion video signal is input from the drive control unit 9 to the source driver 4. The source driver 4 alternately outputs the video signal and the black image signal to the source lines H1 to Hn based on the input black insertion video signal (black insertion video signal providing step).

As shown in FIG. 4, the VSP_i indicating the start of the frame is input from the drive control 9 to the gate driver 5A along with the VOE_i (video start pulse input step), and the VSP_i shifts the gate lines V1 to Vi, as a gate-ON signal in synchronization with the similarly input clock signal (VCK), and turns ON the TFT 12 of the pixel 6 on each gate line V1 to Vi. Meanwhile, the VOE_i is input to the gate driver 5A.

When scanning in the gate driver 5A is terminated, the VSP_i is shift input to the gate driver 5B, and at the same time, the VOE_i is input to the gate driver 5B from the drive control unit 9. In the gate driver 5B, the VSP_i shifts the gate lines V(i+1) to Vj as a gate-ON signal, where the VOE_i is input to the gate driver 5B during the shifting period. The VSP_i is then similarly shift input to the gate driver 5N, and at the same time, the VOE_i is input from the drive control unit 9. In the gate driver 5N as well, the VSP_i shifts the corresponding gate lines V(l+1) to Vm as a gate-ON signal, and the VOE_i is input during the shifting period (video scanning step). The VOE_b is input to the gate drivers 5A to 5N at a period except the above described periods.

The VSP_b from the drive control unit 9 is input to the gate driver 5A once within the frame period according to the timing determined by the black insertion rate setting unit 10 (black display start pulse input step), and similarly, the VSP_b shifts the corresponding lines V1 to Vi as a gate-ON signal by the clock signal (VCK) of the gate driver 5A and turns ON the TFT of the pixel 6 on each gate line V1 to Vi. During such black image display scanning, the VOE_b is input to the gate driver 5A.

When the black image display scanning in the gate driver 5A is terminated, the VSP_b is shift input to the gate driver 5B, and the VSP_b shifts the corresponding gate lines V(i+1) to Vj as a gate-ON signal. The VOE_b is also input to the gate driver 5B during the shifting period. Thereafter, the VSP_b is shift input to the gate driver 5N, and the black image display scanning in the gate driver 5N is started (black scanning step).

Therefore, in the first exemplary embodiment, the video display scanning start pulse (VSP_i) for writing the video lines for once within a frame period and the black display scanning start pulse (VSP_b) for writing the black image line for once within a frame period are input to the gate driver 5A.

According to such configuration, in the screen display, a black image insertion drive in which the black band scrolls through the screen during one frame can be realized, as shown in FIG. 5B. The width of the black band is determined by the timing of the black display scanning start pulse (VSP_B) input with respect to the video display scanning start pulse (VSP_i) input. Furthermore, according to the first exemplary embodiment, the holding time of the video signal and the holding time of the black image signal become constant at all the pixels 6 in the screen by continuing the write of the black image signal in the blanking period between the frames, as shown in FIG. 4, and the in-plane luminance difference caused by the difference in holding times can be eliminated.

The VSP_b can be input at an arbitrary timing as long as it is a timing at which the pixel line of the video signal and the pixel line of the black image signal is not simultaneously selected by one gate driver as in the black VSP settable range shown in FIG. 6, and restrictions such as timing of cut of the gate driver as in the conventional display device are not imposed. The black insertion rate thus can be finely adjusted, and an optimum black insertion rate corresponding to the usage environment can be set in view of the balance between the effect of improving moving image blur, which is the merit of black image insertion, and lowering in luminance, which is the demerit of black image insertion.

In the first exemplary embodiment, the optimum black insertion drive can be applied to any type of the liquid crystal driving method adopted by the display panel 1 which may be TN-type panel, IPS-type panel, VA-type panel, OCB-type panel, or the like.

In the first exemplary embodiment, the moving image blur is alleviated by inserting the black image display between the display frame images in the image display device, but it is not limited to black display, and gray display such as gray may be inserted. In this case, lowering in luminance can be suppressed in addition to alleviating the moving image blur, but the contrast with the color region lowers, and thus a configuration of setting an optimum gray insertion rate with considering such problem is adopted.

In the first exemplary embodiment, the black insertion rate setting unit 10 determines the black image insertion rate for every frame period referring to the input video signal, and sets the timing to start providing the black video display gate-ON signal in the gate drivers 5A to 5N according to the determined black image insertion rate, but it is not limited thereto, and the black insertion rate setting unit 10 may set the timing to start outputting the black display gate-ON signal in the gate drivers 5A to 5N according to the timing data externally input through operation of the user, or the like.

The first exemplary embodiment described above can change the black image insertion rate by changing the timing of inputting the VSP_b to the gate driver 5A, and further, it can also perform normal drive in which the black image insertion is not performed by not inputting the VSP_b, and can easily switch the black image insertion rate. Therefore, a bright screen with small amount of flickers is provided without performing black insertion when used in monitor, and a screen performed with black insertion and with reduced moving image blur is provided for moving image display such as TV, and thus a display corresponding to the usage state of the user can be provided.

Applications such as continuously switching the black image insertion rate depending on the scene of the video, from a static image such as landscape to an active image such as sports, are also possible.

Second Exemplary Embodiment

A second exemplary embodiment of the present invention will now be described.

Figure 8:
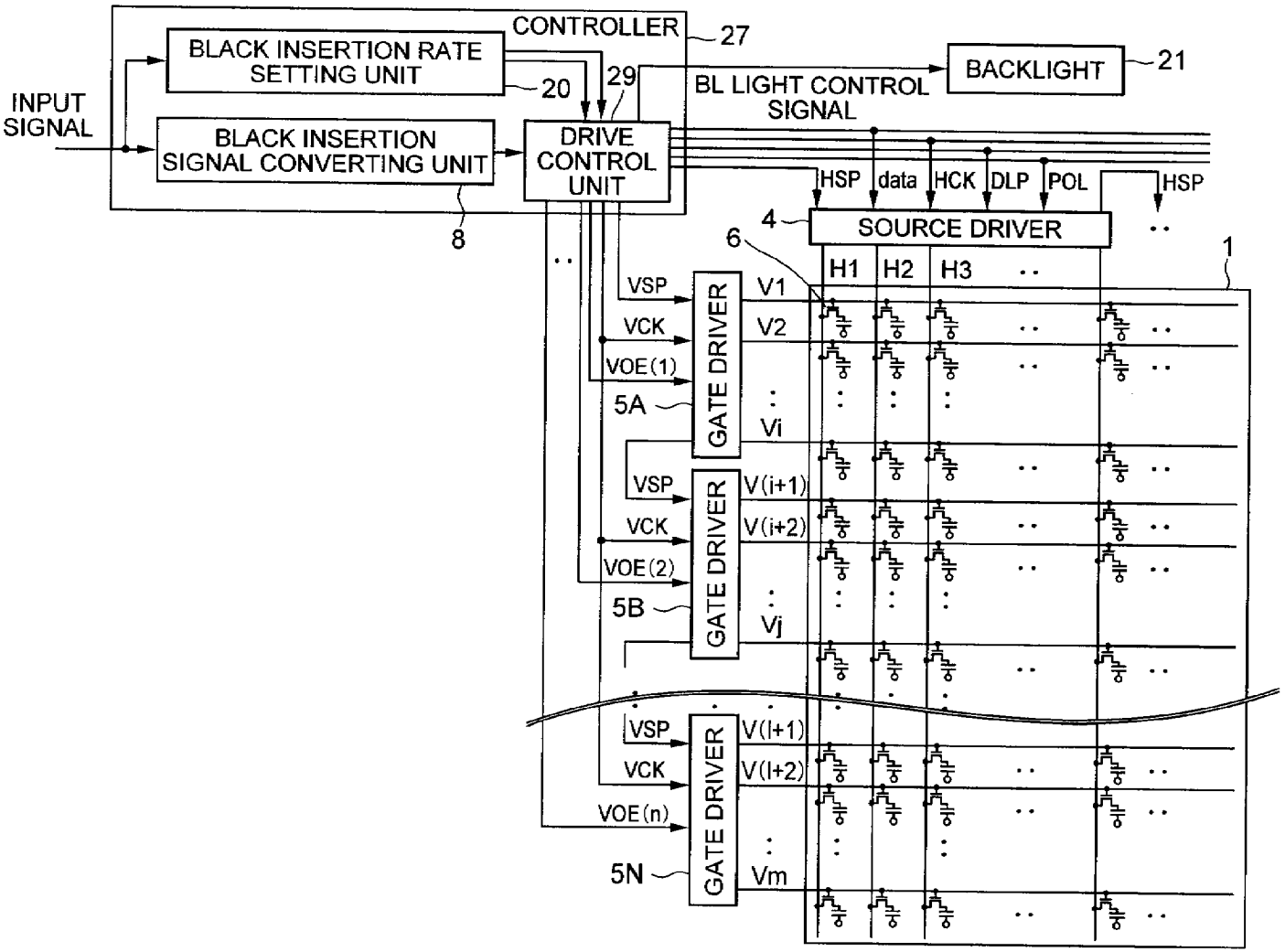
FIG. 8 is a view showing a configuration of an image display device according to a second exemplary embodiment of the present invention.

FIG. 8 is a view showing a configuration of an image display device of a second exemplary embodiment according to the present invention. Same reference numerals are denoted for components same as in the first exemplary embodiment shown in FIG. 1A. As shown in FIG. 8, the second exemplary embodiment has a backlight 21 arranged at the rear surface of the display panel 1 when seen from the user, in addition to the configuration similar to the first exemplary embodiment. A black insertion rate setting unit 20 has a function of temporarily storing information for one frame of the input video signal sequentially input for every frame, comparing the video signal of one frame of the input video signal and the video signal of the previous frame that is temporarily stored, and determining the black image insertion rate and the light control luminance of the backlight based on the changed number of data, and a drive control unit 29 has a function of adjusting the light control luminance of the backlight 21 based on the determination of the black insertion rate setting unit 20.

Figure 9:
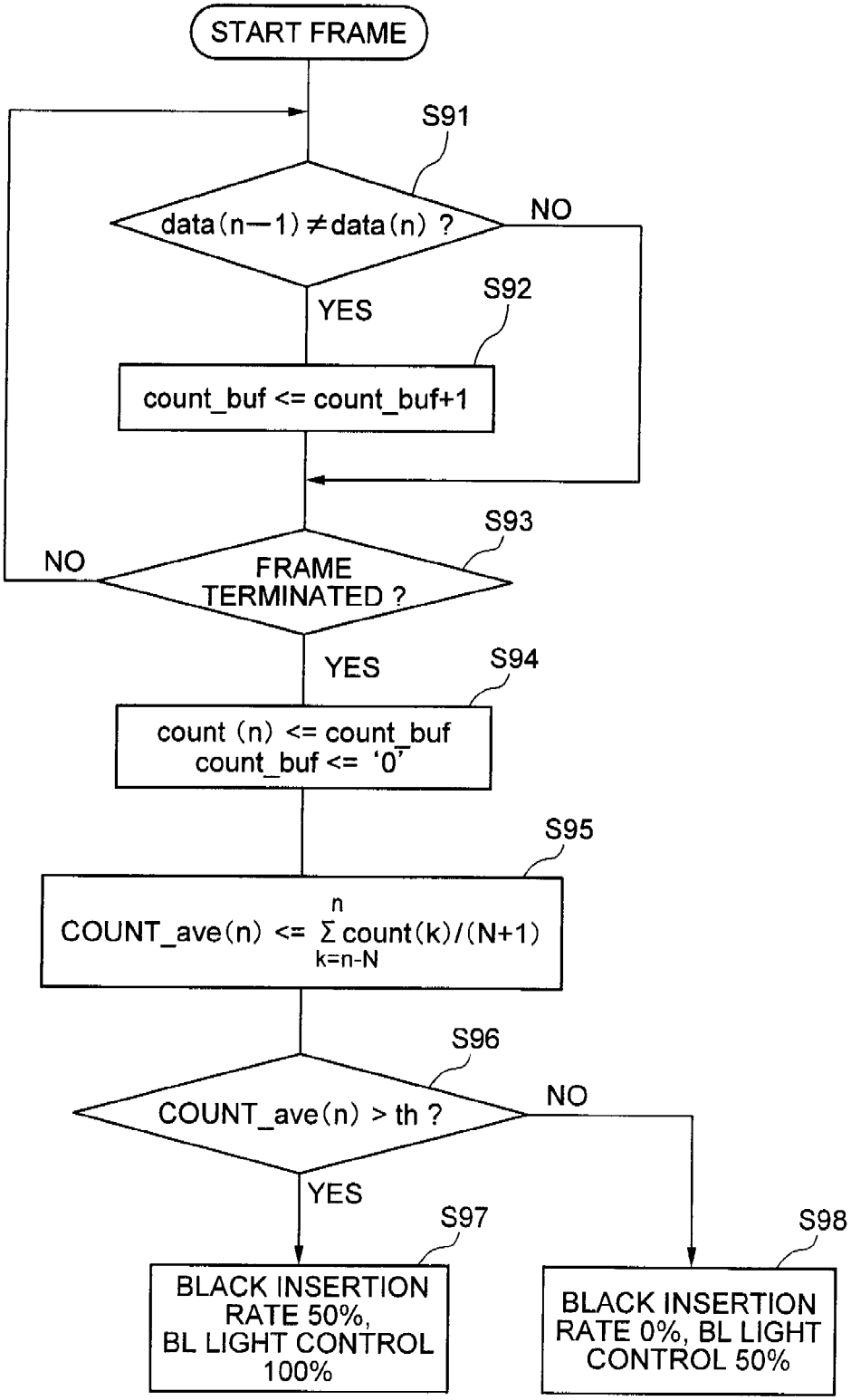
FIG. 9 is a flowchart showing the operation of a black insertion rate setting unit according to the exemplary embodiment shown in FIG. 8.

FIG. 9 is a flowchart showing the operation of the black insertion rate setting unit 20 in the image display device of the second exemplary embodiment.

The black insertion rate setting unit 20 compares current frame data "data (n)" and previous frame data "data (n−1)", and counts the changed data for one frame (FIG. 9: steps S91 to S93). The counted information is moving averaged over a few frames and smoothened (FIG. 9: step S95), and threshold determined (FIG. 9: step S96) to determine whether the image is a static image or a dynamic image.

If the determination result suggests static image, black insertion is not performed and the light control luminance of the backlight 21 is set to 50% (FIG. 9: step S98), whereas if the determination result suggests dynamic image, the black insertion rate is switched to 50% to improve the moving image blur and the light control luminance of the backlight 21 is switched to 100% (FIG. 9: step S97).

Figure 10:
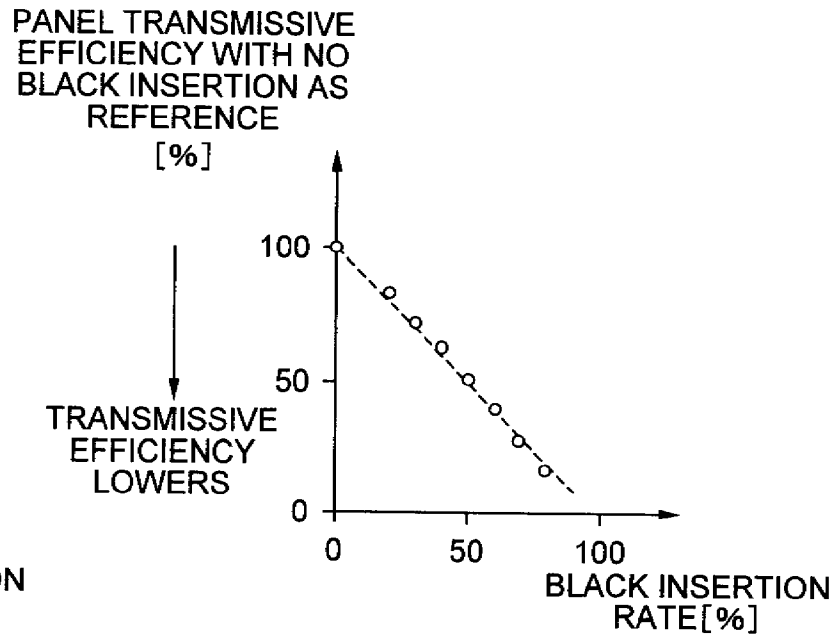
FIG. 10 is a view showing relation characteristics of the black image insertion rate, the moving image blur and transmissive efficiency in the display panel of the present invention.
Figure 10:
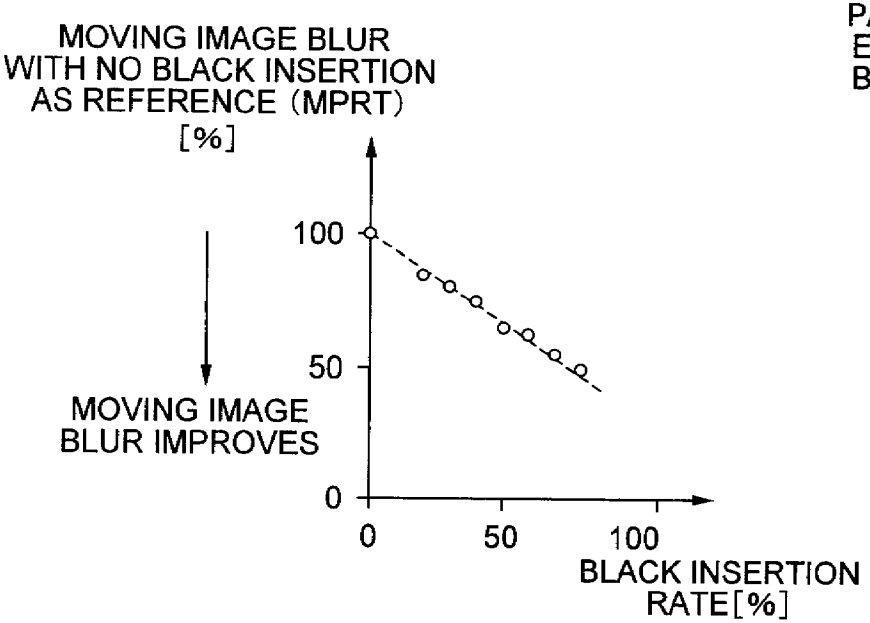

According to such configuration, the black insertion rate can be switched according to the scene of the video, and the moving image blur can be improved as necessary. The reason of adjusting light of the backlight 21 in accordance with the black image insertion is that, in exchange for improvement of the moving image blur, the transmissive efficiency of the panel becomes lower by black image insertion as shown in FIG. 10. The change in luminance due to switching of black insertion can then be prevented, and in the case of static image where black image insertion is unnecessary, power consumption can be reduced by performing light control of the backlight 21.

Figure 11:
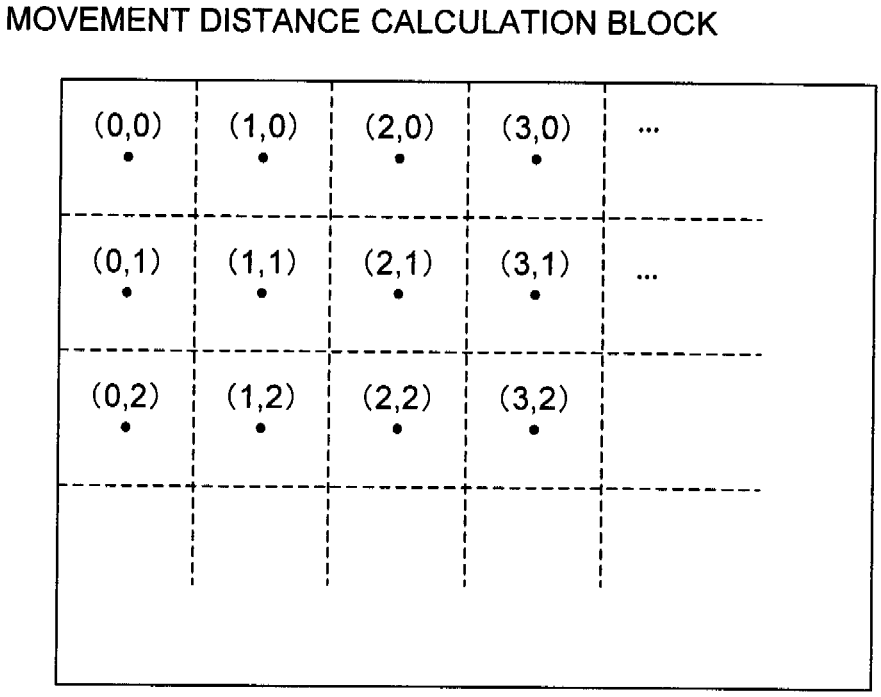
FIG. 11 is a view showing the operation of the black insertion rate setting unit in the exemplary embodiment shown in FIG. 8.
Figure 12:
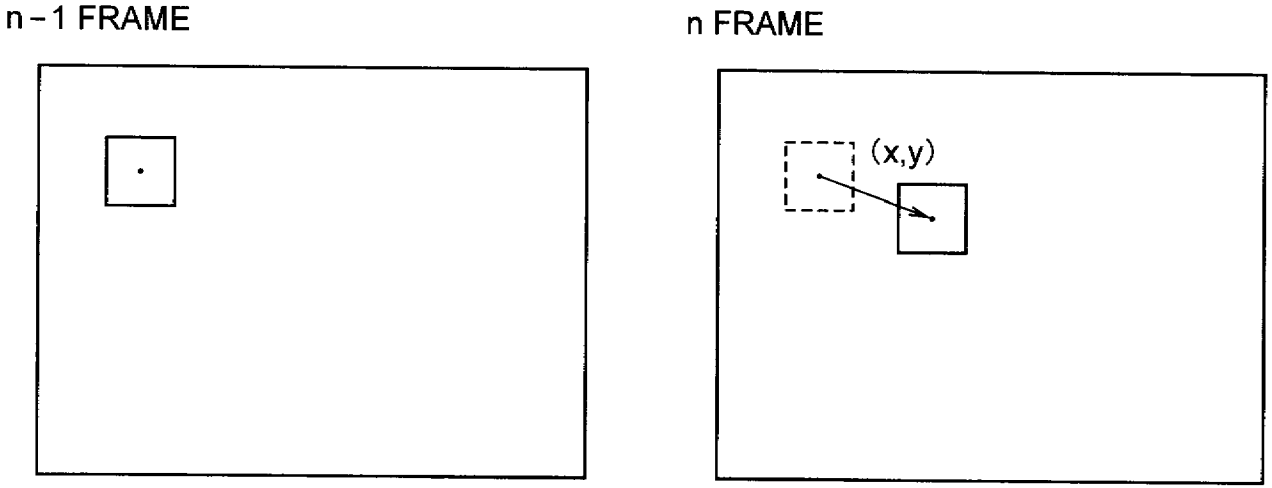
FIG. 12 is a view showing the operation of the black insertion rate setting unit in the exemplary embodiment shown in FIG. 8.
Figure 13:
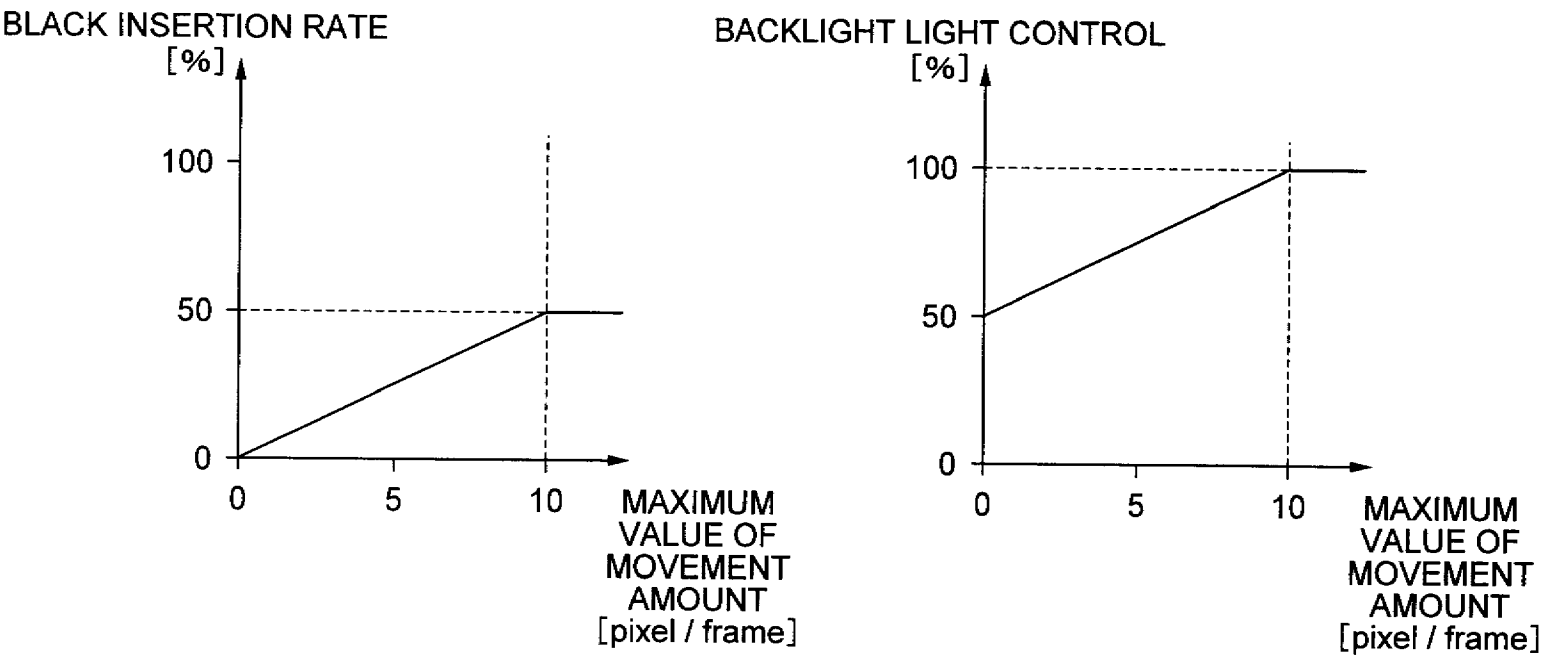
FIG. 13 is a view showing a relationship characteristic of the maximum value of the movement distance of each block calculated by the black insertion rate setting unit, the black insertion rate and light control luminance of a backlight in the exemplary embodiment shown in FIG. 8.
Figure 14:
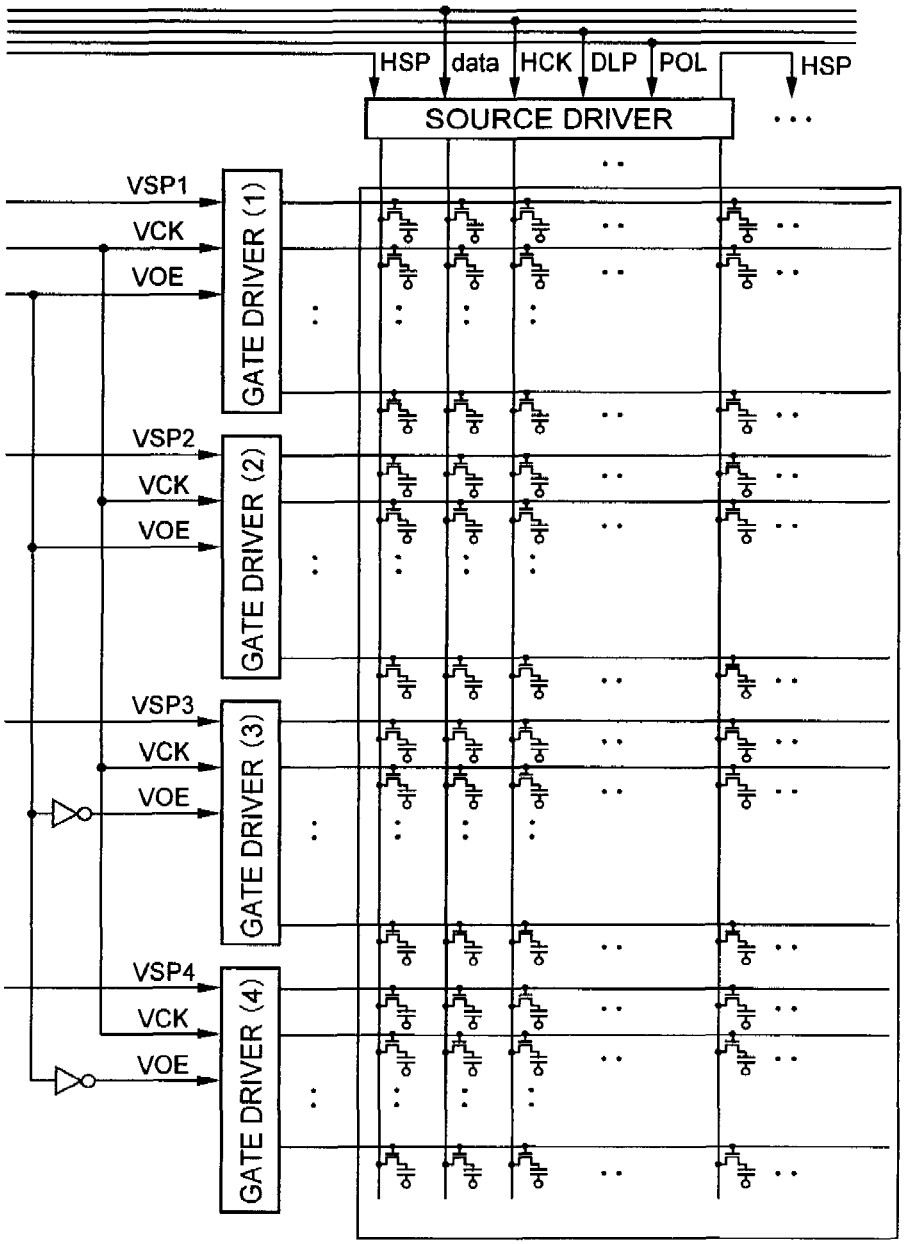
FIG. 14 RELATED ART
FIG. 14 is a view showing a configuration of a conventional image display device.

Another example of the operation of the black insertion rate setting unit 20 in the second exemplary embodiment is shown in FIGS. 11 to 13.

Another method for the black insertion rate setting unit 20 to determine the black image insertion rate and the light control luminance of the backlight includes dividing one frame into a plurality of blocks set in advance, as shown in FIG. 11. Then, the distance the image of an arbitrary block moves from the previous frame to the current frame is calculated, as shown in FIG. 12.

As the method of calculating the distance, the method may be such as detecting, from the current frame, the position of the block of the previous frame and the block in which the average absolute value error is the smallest by using tree search method and the like, and obtaining the distance the relevant block has moved.

The maximum value of the calculated movement distance of each block, and the black insertion rate and the light control luminance of the backlight 21 at the relevant point are shown in FIG. 13. According to such configuration, the power consumption of the backlight can be reduced by continuously switching the black insertion rate according to the movement of the scene of the video, and performing the black image insertion of requisite minimum according to the extent of movement.

Another exemplary embodiment of the present invention will now be described. A third exemplary embodiment of the present invention relates to an image display device equipped with a display panel in which a plurality of gate lines and a plurality of source lines are arranged respectively intersecting each other in a grid form, a pixel being formed at each intersection of the gate lines and the source lines, the image display device including a source line driving device for providing a black insertion video signal, including a line image portion and a black image portion alternately, to each source line, a video scanning device for sequentially providing a video display gate-ON signal for writing only the line image portion of the black insertion video signal to the pixel to each gate line and executing a video display scanning, and a black scanning device for sequentially providing a black display gate-ON signal for writing only the black image portion of the black insertion video signal to the pixel to each gate line and executing a black image display scanning; wherein the black scanning executing device has a configuration of starting the black image display scanning at an arbitrary timing within one video frame period.

According to such image display device, a black insertion drive for writing a black line across successive video frames is executed, and a ratio of the video display time and the black image display time (hereinafter referred to as black image insertion rate) is arbitrarily set by a timing of starting the black image display scanning.

In such image display device, the black scanning executing device may have a function of variably controlling the timing to start the black image display scanning with respect to the video display scanning by the video scanning executing device. The black image insertion rate for every frame thus can be arbitrarily changed.

The image display device may also include a black insertion rate setting unit for arbitrarily setting the timing to start the black image display scanning by the black scanning executing device according to the operation environment. The black image insertion rate for every frame thus can be set from a larger range according to each usage state.

The image display device according to the exemplary embodiment of the present invention may be configured including a display panel in which a plurality of gate lines and a plurality of source lines are arranged respectively intersecting each other in a grid form, a pixel being formed at each intersection of the gate lines and the source lines; a source driver for providing a black insertion video signal, including a line image portion and a black image portion alternately, to each source line; and a plurality of gate drivers arranged with respect to each gate line group, which is a plurality of gate lines being divided into a number of groups, for sequentially providing a gate-ON signal to each corresponding gate line; and a drive control unit having a function of individually providing an output enable signal to each gate driver and independently controlling the gate output of each gate driver, outputting a video start pulse for writing the line image portion, and outputting a black display start pulse for writing the black image portion to a first gate driver at an arbitrary timing within one video frame period.

According to such image display device, the gate driver is arranged for each gate line group, which is a plurality of gate lines being divided into a number of groups, the enable of each gate driver is individually controlled, and the black display start pulse is input to the gate driver at a timing different from the image start pulse, and thus the ratio between the video display time and the black image display time (hereinafter referred to as black image insertion rate) in the black insertion drive can be continuously adjusted instead of being driver segmented. The number of the gate driver may be in odd numbers if it is greater than or equal to two, and thus the degree of flexibility of gate driver selection increases in applying to the product, and the black insertion rate can be freely set with the gate driver of necessity minimum.

In such image display device, the drive control unit may also have a function of variably controlling the timing of a black display start pulse output with respect to a video start pulse output. With this, the black image insertion rate for every frame can be arbitrarily changed by changing the timing of the black display start pulse output.

In the above image display device, the drive control unit may have a function of individually providing to each gate driver a video display enable signal for validating the gate output of the gate driver only during the period the line image portion of the black insertion video signal is being provided to the source line, or a black display enable signal for validating the gate output of the gate driver only during the period the black image portion of the black insertion video signal is being provided to the source line. With this, the execution of the video display scanning or the black image display scanning can be individually controlled with respect to each gate driver.

In the above image display device, each gate driver may have a function of providing to the corresponding gate line, the video display gate-ON signal for writing only the line portion of the black insertion video signal to the pixel according to the video display enable signal, and providing to the corresponding gate line the black display gate-ON signal for writing only the black image portion of the black insertion video signal to the pixel according to the black display enable signal.

With this, each gate driver can switch and execute the video display scanning or the black image display scanning.

The image display device may also include a black insertion rate setting unit for arbitrarily setting the timing of the black display start pulse output by the drive control unit according to the operation environment. With this, the black image insertion rate for every frame can be set from a larger range according to each usage state.

In the above image display device, the black insertion rate setting unit may have a function of determining the black image insertion rate for every frame period based on the input video signal, and setting the timing of the black display start pulse output based on the determined black image insertion rate. With this, the black image insertion rate can be set according to the content of the displaying video.

Furthermore, in the image display device, the black insertion rate setting unit may have a function of temporarily storing information for one frame of the input video signal sequentially input for every frame, comparing the video signal of one frame of the input video signal and the video signal of the previous frame that is temporarily stored, and determining the black image insertion rate based on the changed data. With this, the optimum black image insertion rate can be determined according to the content of the displaying video.

Furthermore, the image display device also includes a backlight arranged at the rear surface of the display panel, where the black insertion rate setting unit may have a function of temporarily storing information for one frame of the input video signal sequentially input for every frame, comparing the video signal of one frame of the input video signal and the video signal of the previous frame that is temporarily stored, and determining the black image insertion rate and the light control luminance of the backlight based on the changed data.

With this, the backlight is light controlled according to black insertion, and black insertion drive can be executed while preventing change in luminance due to switching of black insertion.

In the above image display device, the drive control unit may provide the video display enable signal to the gate driver for shift outputting the gate-ON signal to each corresponding gate line according to the video start pulse input until such shift output is terminated, and provide the black display enable signal to other gate drivers. The black display start pulse input with respect to the gate driver becomes possible at a timing with high degree of flexibility, and the black image insertion rate can be continuously adjusted.

The image display device may include a black insertion signal converting unit for inserting the black image signal between the line image portions in the input image signal, and outputting to the source driver as a black insertion video signal. With this, the black insertion video signal for the source driver to alternately output the line image portion and the black image portion to each source line can be obtained.

In the above image display device, the black insertion video signal has features in including the black image signal even in a blanking period in the input video signal. With this, the write of black signal is performed without stopping even in the blanking period between the frames with respect to the write of the black signal over a plurality of image frames, and thus the in-plane luminance difference caused by difference in black image holding periods in the display panel can be eliminated.

In the image display device, the black insertion video signal has features in including a gray signal in place of the black image signal. With this, the lowering in luminance due to black insertion drive can be alleviated.

A method of driving an image display device according to an exemplary embodiment is a method of driving an image display device including a display panel in which a plurality of gate lines and a plurality of source lines are arranged respectively intersecting each other in a grid form, a pixel being formed at each intersection of the gate lines and the source lines; a source driver for providing a video signal to each source line; a plurality of gate drivers, arranged with respect to each gate line group, which is a plurality of gate lines being divided into a number of groups, for sequentially providing a gate-ON signal to each corresponding gate line; and a drive control unit for individually providing an output enable signal to each gate driver; and the method may include a black insertion video signal providing step in which the source driver starts to provide to each source line a black insertion video signal alternately including a line image portion and a black image portion; a video start pulse input step in which the drive control unit inputs to a first gate driver a video display start pulse for writing the line image portion in synchronization with the black insertion video signal providing step; a video scanning step in which a video display scanning of sequentially providing to each gate line a video display gate-ON signal for writing only the line image portion of the black insertion video signal to the pixel is executed in order from the first gate driver; a black display start pulse input step in which the drive control unit inputs to the first gate driver a black display start pulse for writing the black image portion at an arbitrary timing within one image frame; and a black scanning step in which a black image display scanning of sequentially providing to each gate line a black display gate-ON signal for writing only the black image portion of the black insertion video signal to the pixel is executed in order from the first gate driver.

In such driving method, each gate driver may output the video display gate-ON signal according to the video display enable signal for validating the gate output of the gate driver only during the period the line image portion of the black insertion video signal is being provided to the source line in the video scanning step, and may output the black display gate-ON signal according to the black display enable signal for validating the gate output of the gate driver only during the period the black image portion of the black insertion video signal is being provided to the source line in the black scanning step.

The above driving method may include a black insertion rate setting step of arbitrarily setting the timing of the black display start pulse output by the drive control unit according to the operation environment.

According to the above driving method, the black insertion rate setting step may includes, temporarily storing information for one frame of the input video signal sequentially input for every frame, comparing the video signal of one frame of the input video signal and the video signal of the previous frame that is temporarily stored, determining the black image insertion rate based on the changed data, and setting the timing of the black display start pulse based on the determined black image insertion rate.

Furthermore, according to the driving method, the black inserting rate setting step may includes, temporarily storing information for one frame of the input video signal sequentially input for every frame, comparing the video signal of one frame of the input video signal and the video signal of the previous frame that is temporarily stored, determining the black image insertion rate and the light control luminance of the backlight arranged at the rear surface of the display panel in advance based on the changed data, and setting the timing of the black display start pulse and the light control luminance of the backlight based on such determination.

The driving method may includes a black insertion signal converting step of inserting the black image signal between the line image portions in the input image signal, and outputting to the source driver as a black insertion video signal, before the black insertion video signal providing step.

In the above method of driving the image display device, the black insertion video signal has features in including the black image signal even in a blanking period in the input video signal.

In the above method of driving the image display device, the black insertion video signal may include a gray signal in place of the black image signal.

Similar to the image display device, according to the method of driving the image display device, the black insertion rate can be finely set in view of the balance between improving the moving image blur, which is the merit, and lowering in luminance, which is the demerit.

An image display device driving program according to an exemplary embodiment of the present invention causes a computer for controlling the operation of the image display device to execute processes, the image display device including a display panel in which a plurality of gate lines and a plurality of source lines are arranged respectively intersecting each other in a grid form, a pixel being formed at each intersection of the gate lines and the source lines; a source driver for providing a video signal to each source line; a plurality of gate drivers, arranged with respect to each gate line group, which is a plurality of gate lines being divided into a number of groups, for sequentially providing a gate-ON signal to each corresponding gate line; where the process includes a video signal providing process of outputting a black insertion video signal, including a line image portion and a black image portion alternately, from the source driver to each source line; a drive controlling process of individually providing an output enable signal to each gate driver and independently controlling the gate output of each gate driver; a video start pulse output process of outputting a video start pulse input for writing the line image portion to a first gate driver; and a black display start pulse output process of outputting a black display start pulse for writing the black image portion to the first gate driver at an arbitrary timing within one image frame.

In the above image display device driving program, the drive control process may be specified to a content of individually providing to each gate driver a video display enable signal for validating the gate output of the gate driver only during the period the line image portion of the black insertion video signal is being provided to the source line, or a black display enable signal for validating the gate output of the gate driver only during the period the black image portion of the black insertion video signal is being provided to the source line.

Furthermore, the image display device driving program may cause the computer to execute a black insertion rate setting process of arbitrarily setting the timing of the black display scanning process according to the operation environment.

In the above image display device driving program, the black insertion rate setting process may be specified to a content of temporarily storing information for one frame of the input video signal sequentially input for every frame, comparing the video signal of one frame of the input video signal and the video signal of the previous frame that is temporarily stored, determining the black image insertion rate for every frame period based on the changed data, and setting the timing of the black display scanning process based on the determined black image insertion rate.

Furthermore, according to the above image display device driving program, the black inserting rate setting process may be specified to a content of temporarily storing information for one frame of the input video signal sequentially input for every frame, comparing the video signal of one frame of the input video signal and the video signal of the previous frame that is temporarily stored, determining the black image insertion rate and the light control luminance of the backlight arranged at the rear surface of the display panel in advance based on the changed number of data, and setting the timing of the black display scanning for every gate line group and the light control luminance of the backlight based on such determination.

The above image display device driving program may cause a computer to execute a black insertion video signal creating process of inserting the black image signal between the line image portions in the input image signal, and outputting to the source driver as a black insertion video signal.

In the above image display device driving program, the black insertion video signal has features in including the black image signal even in a blanking period in the input video signal.

In the above image display device driving program, the black insertion video signal may include a gray signal in place of the black image signal.

Similar to the image display device, according to the image display device driving program, the black insertion rate can be finely set in view of the balance between improving the moving image blur, which is the merit, and lowering in luminance, which is the demerit.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A hold type image display system for displaying a video on a display panel by controlling a video signal to be input to a source line and a gate line of the display panel, the hold type image display system comprising;

a source driver for outputting a video signal to the source line;

a gate driver for outputting a scanning signal to the gate line;

a controller for receiving an input video signal and thereby controlling the source driver and the gate driver; and a backlight on a rear surface of the display panel, wherein the gate driver is configured by two or more gate drivers for collectively enabling a gate output for every gate line group;

the controller independently controls an output enable signal to be input to the respective gate driver, outputs a video signal in which a black or gray line is inserted between video lines to the source driver, outputs a start pulse single for writing the video lines for one or more times and a start pulse signal for writing black or gray lines for one or more times to the gate driver within one frame period, and scrolls a black band in a screen of the display panel during one frame;

the controller determines a black or gray insertion rate according to a display, and changes a timing of input of the start pulse signal to the gate driver to write the black or gray lines with respect to input of the start pulse signal to the gate driver to write the video lines based on the determined black or gray insertion rate;

the controller compares preceding and following video signals in one frame unit to switch a black image insertion rate; and adjusts the light control luminance of the backlight so that the change in luminance due to switching of the black image insertion rate can be prevented;

the controller divides one frame into a plurality of blocks set in advance, calculates a distance an image of an arbitrary block moves from a previous frame to a current frame, and continuously switches the black image insertion rate according to a maximum value of the calculated movement distance of each block to adjust a light control luminance of the backlight; and the controller compares the preceding and following video signals in one frame unit to determine whether the image is a static image or a dynamic image, and if a determination result suggests static image, black insertion is not performed and the light control luminance of the backlight is set to 50%, whereas if the determination result suggests dynamic image, the black insertion rate is switched to 50% and the light control luminance of the backlight is switched to 100%.

2. The hold type image display system as claimed in claim 1, wherein the controller continuously holds write of a black image signal during a blanking period between preceding and following frame periods in a manner that a holding time of the video signal and a holding time of the black image signal become constant at all pixels in the screen.

3. The hold type image display system as claimed in claim 1, wherein the source driver is configured to output a tone voltage corresponding to black display to the source line.

4. The hold type image display system as claimed in claim 1, wherein the start pulse signal for writing the black or gray lines is input at an arbitrary timing at which the pixel lines for writing the video lines and for writing the black or gray line are not simultaneously selected with one gate driver.

5. A control device of a hold type image display system for displaying a video on a display panel by controlling a video signal to be input to a source line and a gate line of the display panel, the control device comprising;

a source driver for outputting a video signal to the source line;

a gate driver for outputting a scanning signal to the gate line;

a controller for receiving an input video signal and thereby controlling the source driver and the gate driver; and a backlight on a rear surface of the display panel, wherein the gate driver is configured by two or more gate drivers for collectively enabling a gate output for every gate line group;

the controller independently controls an output enable signal to be input to the respective gate driver, outputs a video signal in which a black or gray line is inserted between video lines to the source driver, outputs a start pulse single for writing the video lines for one or more times and a start pulse signal for writing black or gray lines for one or more times to the gate driver within one frame period, and scrolls a black band in a screen of the display panel during one frame;

the controller determines a black or gray insertion rate according to a display, and changes a timing of input of the start pulse signal to the gate driver to write the black or gray lines with respect to input of the start pulse signal to the gate driver to write the video lines based on the determined black or gray insertion rate;

the controller compares preceding and following video signals in one frame unit to switch a black image insertion rate; and adjusts the light control luminance of the backlight so that the change in luminance due to switching of the black image insertion rate can be prevented;

the controller divides one frame into a plurality of blocks set in advance, calculates a distance an image of an arbitrary block moves from a previous frame to a current frame, and continuously switches the black image insertion rate according to a maximum value of the calculated movement distance of each block to adjust a light control luminance of the backlight; and the controller compares the preceding and following video signals in one frame unit to determine whether the image is a static image or a dynamic image, and if a determination result suggests static image, black insertion is not performed and the light control luminance of the backlight is set to 50%, whereas if the determination result suggests dynamic image, the black insertion rate is switched to 50% and the light control luminance of the backlight is switched to 100%.

6. The control device of the hold type image display system as claimed in claim 5, wherein the controller continuously holds write of a black image signal during a blanking period between preceding and following frame periods in a manner that a holding time of the video signal and a holding time of the black image signal become constant at all pixels in the screen.

7. The control device of the hold type image display system as claimed in claim 5, wherein the source driver is configured to output a tone voltage corresponding to black display to the source line.

8. The control device of the hold type image display system as claimed in claim 5, wherein the start pulse signal for writing the black or gray lines is input at an arbitrary timing at which the pixel lines for writing the video lines and for writing the black or gray line are not simultaneously selected with one gate driver.

9. A hold type image display method for displaying a video on a display panel by controlling a video signal to be input to a source line and a gate line of the display panel, the hold type image display method comprising;

receiving an input video signal and thereby controlling a source driver for outputting the video signal to the source line and a gate driver for outputting a scanning signal to the gate line;

independently controlling an output enable signal to be input to the respective gate driver, outputting a video signal in which a black or gray line is inserted between video lines to the source driver, outputting a start pulse single for writing the video lines for one or more times and a start pulse signal for writing black or gray lines for one or more times to the gate driver within one frame period, and scrolling a black band in a screen of the display panel during one frame;

determining a black or gray insertion rate according to a display, and changing a timing of input of the start pulse signal to the gate driver to write the black or gray lines with respect to input of the start pulse signal to the gate driver to write the video lines based on the determined black or gray insertion rate;

comparing preceding and following video signals in one frame unit to switch a black image insertion rate; and adjusting the light control luminance of a backlight so that the change in luminance due to switching of the black image insertion rate can be prevented;

dividing one frame into a plurality of blocks set in advance, calculating a distance an image of an arbitrary block moves from a previous frame to a current frame, and continuously switching the black image insertion rate according to a maximum value of the calculated movement distance of each block to adjust a light control luminance of the backlight; and comparing the preceding and following video signals in one frame unit to determine whether the image is a static image or a dynamic image, and if a determination result suggests static image, not performing black insertion and setting the light control luminance of the backlight to 50%, whereas if the determination result suggests dynamic image, switching the black insertion rate to 50% and switching the light control luminance of the backlight to 100%, wherein, the gate driver is configured by two or more gate drivers for collectively enabling a gate output for every gate line group.

10. The hold type image display method as claimed in claim 9, further comprising continuously holding write of a black image signal during a blanking period between preceding and following frame periods in a manner that a holding time of the video signal and a holding time of the black image signal become constant at all pixels in the screen.

11. The hold type image display method as claimed in claim 9, wherein the source driver is configured to output a tone voltage corresponding to black display to the source line.

12. The hold type image display method as claimed in claim 9, wherein the start pulse signal for writing the black or gray lines is input at an arbitrary timing at which the pixel lines for writing the video lines and for writing the black or gray line are not simultaneously selected with one gate driver.

* * * * *